US009708697B2

(12) United States Patent
Masuda et al.

(10) Patent No.: US 9,708,697 B2
(45) Date of Patent: Jul. 18, 2017

(54) HIGH STRENGTH COLD-ROLLED STEEL SHEET AND MANUFACTURING METHOD THEREFOR

(71) Applicant: Kobe Steel, Ltd., Kobe-shi (JP)

(72) Inventors: Tomokazu Masuda, Kobe (JP); Katsura Kajihara, Kobe (JP); Toshio Murakami, Kobe (JP); Masaaki Miura, Kakogawa (JP); Muneaki Ikeda, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 260 days.

(21) Appl. No.: 14/400,453

(22) PCT Filed: May 29, 2013

(86) PCT No.: PCT/JP2013/064920

§ 371 (c)(1),
(2) Date: Nov. 11, 2014

(87) PCT Pub. No.: WO2013/180180

PCT Pub. Date: Dec. 5, 2013

(65) Prior Publication Data

US 2015/0144231 A1 May 28, 2015

(30) Foreign Application Priority Data

May 31, 2012 (JP) ..... 2012-124207
May 31, 2012 (JP) ..... 2012-124208

(51) Int. Cl.
*C22C 38/02* (2006.01)
*C22C 38/04* (2006.01)
(Continued)

(52) U.S. Cl.
CPC ..... *C22C 38/38* (2013.01); *C21D 1/18* (2013.01); *C21D 8/0226* (2013.01);
(Continued)

(58) Field of Classification Search
None
See application file for complete search history.

(56) References Cited

U.S. PATENT DOCUMENTS 8,343,288 B2 1/2013 Murakami et al.
8,679,265 B2 3/2014 Murakami et al.
(Continued)

FOREIGN PATENT DOCUMENTS

JP 2000 212684 8/2000
JP 2003 277832 10/2003
(Continued)

OTHER PUBLICATIONS

Machine-English translation of JP2010-090432, Yoshino Masataka et al., Apr. 22, 2010.*
(Continued)

*Primary Examiner* — Deborah Yee
(74) *Attorney, Agent, or Firm* — Oblon, McClelland, Maier & Neustadt, L.L.P.

(57) ABSTRACT

In a steel sheet having a specific chemical composition and having a microstructure including ferrite that is a soft first phase by 20-50% in terms of the area ratio, the remainder being tempered martensite and/or tempered bainite that is a hard second phase, the microstructure of steel of a surface layer section of the steel sheet from the surface to the depth of 100 μm and a center section of t/4-3t/4 (t is the sheet thickness) is controlled.

18 Claims, 2 Drawing Sheets

(51) Int. Cl.

| | |
|---|---|
| ***C22C 38/06*** | (2006.01) |
| ***C22C 38/34*** | (2006.01) |
| ***C22C 38/38*** | (2006.01) |
| ***C22C 38/18*** | (2006.01) |
| ***C22C 38/40*** | (2006.01) |
| ***C21D 8/02*** | (2006.01) |
| ***C21D 9/46*** | (2006.01) |
| ***C21D 8/12*** | (2006.01) |
| ***C22C 38/00*** | (2006.01) |
| ***C22C 38/08*** | (2006.01) |
| ***C22C 38/12*** | (2006.01) |
| ***C22C 38/16*** | (2006.01) |
| ***C21D 1/18*** | (2006.01) |
| *C21D 1/25* | (2006.01) |

(52) U.S. Cl.

CPC ..... *C21D 8/0236* (2013.01); *C21D 8/0263* (2013.01); *C21D 8/1272* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/18* (2013.01); *C22C 38/34* (2013.01); *C21D 1/25* (2013.01); *C21D 2211/002* (2013.01); *C21D 2211/005* (2013.01); *C21D 2211/008* (2013.01)

(56) References Cited

U.S. PATENT DOCUMENTS

| | | | |
|---|---|---|---|
| 8,840,738 | B2 | 9/2014 | Murakami et al. |
| 2009/0277547 | A1 | 11/2009 | Saito et al. |
| 2014/0305553 | A1 | 10/2014 | Masuda et al. |

FOREIGN PATENT DOCUMENTS

| | | | |
|---|---|---|---|
| JP | 2003 321727 | | 11/2003 |
| JP | 2005 273002 | | 10/2005 |
| JP | 2006 104546 | | 4/2006 |
| JP | 2007 138262 | | 6/2007 |
| JP | 2008 156734 | | 7/2008 |
| JP | 2010-090432 | * | 4/2010 |
| JP | 2011 42879 | | 3/2011 |
| JP | 2011 140695 | | 7/2011 |

OTHER PUBLICATIONS

U.S. Appl. No. 14/400,432, filed Nov. 11, 2014, Masuda, et al.
International Search Report Issued Aug. 20, 2013 in PCT/JP13/064920 Filed May 29, 2013.
Written Opinion of the International Searching Authority issued Jun. 20, 2013 in PCT/JP13/064920 Filed May 29, 2013.

* cited by examiner

HIGH STRENGTH COLD-ROLLED STEEL SHEET AND MANUFACTURING METHOD THEREFOR

TECHNICAL FIELD

The invention of the present application relates to a high strength cold-rolled steel sheet used for automobile components and the like and a manufacturing method for the same, and relates more specifically to a high strength cold-rolled steel sheet exhibiting little variation in the mechanical property or a high strength cold-rolled steel sheet excellent in bendability.

BACKGROUND ART

In recent years, in order to achieve both of fuel economy improvement and collision safety of an automobile, there is a growing need for a high strength steel sheet having the tensile strength of 590 MPa or more, 780 MPa or more, and particularly 980 MPa or more as a material for structural components, and the application range thereof is widening. However, because the variation in the mechanical property such as the yield strength, tensile strength, work hardening index, and the like of the high strength steel sheet is large compared to that of a mild steel, there are problems that the dimensional accuracy of the press formed product is hardly secured because the spring-back quantity changes in press forming, and that the life of the press forming tool is shortened because the average strength of the steel sheet should be set high in order to secure the required strength of the press formed product even when the strength varies.

In order to solve such problems, various trials have been made with respect to suppressing the variation in the mechanical property in the high strength steel sheet. The cause of generation of the variation in the mechanical property as described above in the high strength steel sheet can be attributed to the fluctuation in the chemical composition and the variation of the manufacturing condition, and following proposals have been made with respect to methods for reducing the variation in the mechanical property.

[Prior Art 1]

For example, in Patent Literature 1, a method for reducing the variation in the mechanical property is disclosed in which the steel sheet is made a dual-phase microstructure steel having ferrite and martensite in which A defined by $A=Si+9\times Al$ satisfies $6.0\leq A\leq 20.0$, in manufacturing the steel sheet, recrystallization annealing/tempering treatment is executed by holding at a temperature of Ac1 or above and Ac3 or below for 10 s or more, slow cooling at a cooling rate of 20° C./s or less for 500-750° C., rapid cooling thereafter at a cooling rate of 100° C./s or more to 100° C. or below, and tempering at 300-500° C., thereby A3 point of the steel is raised, and thereby the stability of the dual-phase microstructure when the rapid cooling start temperature that is the temperature of the slow cooling completion time point fluctuates is improved.

[Prior Art 2]

Also, in Patent Literature 2, a method is disclosed in which the variation in the strength is reduced by that the relation between the tensile strength and the sheet thickness, carbon content, phosphorus content, quenching start temperature, quenching stop temperature, and tempering temperature after quenching of the steel sheet is obtained beforehand, the quenching start temperature is calculated according to the target tensile strength considering the sheet thickness, carbon content, phosphorus content, quenching stop temperature, and tempering temperature after quenching of the steel sheet of the object, and quenching is executed with the quenching start temperature obtained.

[Prior Art 3]

Also, in Patent Literature 3, there is disclosed a method for improving the variation in the elongation property in the sheet width direction by soaking at over 800° C. and below Ac3 point for 30 s-5 min, thereafter executing the primary cooling to the temperature range of 450-550° C., then executing secondary cooling to 450-400° C. with a lower cooling rate than the primary cooling rate, and holding thereafter at 450-400° C. for 1 min or more in the annealing treatment after cold-rolling the hot-rolled steel sheet in manufacturing a steel sheet having the microstructure including 3% or more of the retained austenite.

[Prior Art 4]

Also, in Patent Literature 4, there is disclosed a method for improving the drawability of a high strength hot-dip galvanizing-coated steel sheet by achieving the microstructure including a ferrite phase having the average grain size of 10 μm or less and a martensitic phase having the volumetric fraction of 30-90% in which the ratio of the sheet thickness surface layer hardness with respect to the sheet thickness center hardness is 0.6-1, the maximum depth of the crack and the recess developing from the boundary face between the coating layer and the steel sheet to the inside on the steel sheet side is 0-20 μm, and the area ratio of the flat section other than the crack and the recess is 60%-100%.

The prior art 1 described above is characterized to suppress a change in the microstructure fraction caused by the fluctuation in the annealing temperature by increasing the addition amount of Al and raising Ac3 point, thereby expanding the dual-phase temperature range of Ac1-Ac3, and reducing the temperature dependability within the dual-phase temperature range. On the other hand, the invention of the present application is characterized to suppress the fluctuation in the mechanical property caused by the change in the heat treatment condition by equalizing the fraction and the hardness of the hard and soft phases of the steel sheet surface layer section and the inside. Accordingly, the prior art 1 described above does not suggest the technical thought of the invention of the present application. Also, because the prior art 1 described above requires to increase the addition amount of Al, there is also a problem of an increase in the manufacturing cost of the steel sheet.

Further, according to the prior art 2 described above, the quenching temperature is changed according to the change in the chemical composition, therefore the variation in the strength can be reduced, however the microstructure fraction fluctuates among the coils, and therefore the variation in elongation and stretch flange formability cannot be reduced.

Furthermore, although the prior art 3 described above suggests reduction of the variation in elongation, reduction of the variation in stretch flange formability is not suggested.

Further, according to the prior art 4 described above, with the aim of improving the press formability, the average grain size of the ferrite phase is specified to be 10 μm or less and the hardness ratio of the steel sheet surface layer and the center is specified to be 0.6-1. However, because the grain size of the ferrite phase is specified only by the average value, when there is a large variation in the magnitude of the size of each ferrite grain, improvement of the press formability cannot be expected. Further, although the hardness ratio of the steel sheet surface layer and the center is specified, a large/small relationship of the hardness and the deformability of the hard and soft phases do not agree to each other. For example, between a case where the fraction of the hard phase tempered inferior in deformability is high and a case where the fraction of the soft phase excellent in deformability is high, even when the hardness is the same, the press formability is different, and therefore it is supposed that the variation occurs in the degree of improvement of the press formability even though both cases are effective in improvement of the press formability.

Further, in general, in order to manufacture structural components for an automobile using a high strength steel sheet, complicated press forming and bending work are executed, however, because a similar work is executed also for the high strength steel sheet of 780 MPa or more, particularly 980 MPa or more, not only the ductility and stretch flange formability but also excellent bendability is required.

In the meantime, in bending the steel sheet, a large tensile stress is generated in the circumferential direction in the surface layer section on the bending outer periphery side and a large compressive stress is generated in the circumferential direction in the surface layer section on the bending inner periphery side. Therefore, it is known that, by arranging a soft layer in the surface layer section of the steel sheet, these stresses are relaxed and the bendability is improved. As such a high strength steel sheet provided with a soft layer in the surface layer section of the steel sheet, such proposals as described below have been made.

[Prior Art 5]

For example, in Patent Literature 5, an ultra-high strength cold-rolled steel sheet is disclosed which contains C: 0.03-0.2%, Si: 0.05-2% or less, Mn: 0.5-3.0%, P: 0.1% or less, S: 0.01% or less, SolAl: 0.01-0.1%, and N: 0.005% or less, with the remainder consisting of Fe and inevitable impurities, in which a soft phase with the volumetric ratio of ferrite by 90% or more and the thickness of 10-100 μm is provided in the steel sheet surface layer, and the microstructure in the center section has tempered martensite with the volumetric ratio by 30% or more with the remainder being the ferrite phase.

[Prior Art 6]

Also, in Patent Literature 6, a high strength automobile member is disclosed which is characterized that the thickness of the surface layer is 1 nm-300 μm, the surface layer is a decarburized layer mainly of ferrite, the chemical composition of the inner layer steel contains C: 0.1-0.8% and Mn: 0.5-3% in mass %, and the tensile strength is 980 $N/mm^2$ or more.

The prior art 5 described above is to attempt to improve the bendability by that two step cooling is executed after annealing combining cooling of the steel sheet surface layer first by slow cooling and cooling of the entire steel sheet next by rapid cooling, thereby the microstructure is made different between the surface layer and the center section, and a soft layer generally composed of ferrite only is formed in the steel sheet surface layer. However, according to this technology, crystal grains are liable to grow during annealing, and in the surface layer particularly, ferrite grains whose size is non-uniform compared with the microstructure in the center section are liable to be formed. When the size of the ferrite grains becomes non-uniform, not only the bendability itself deteriorates but also conspicuous unevenness is formed on the surface of a strong working section, and therefore a problem of deterioration of the surface shape also occurs.

Further, the prior art 6 described above is to attempt to reduce the sensitivity with respect to the delayed fracture by that the thickness of the surface layer is made 1 nm-300 μm, the surface layer is made a decarburized layer with 50% or more of ferrite in terms of mass %, and thereby the dehydrogenizing rate after hot stamping is significantly increased. Here, the inner layer is rapid-cooled after hot stamping and is transformed into a microstructure mainly formed of martensite, therefore, even though deformation may be followed during hot stamping, in cold working, bending work is difficult because the property of the surface layer and the inner layer is extremely different from each other.

CITATION LIST

Patent Literature

[Patent Literature 1] JP-A 2007-138262
[Patent Literature 2] JP-A 2003-277832
[Patent Literature 3] JP-A 2000-212684
[Patent Literature 4] JP-A 2008-156734
[Patent Literature 5] JP-A 2005-273002
[Patent Literature 6] JP-A 2006-104546

SUMMARY OF INVENTION

Technical Problems

The invention of the present application has been developed in order to solve the problems described above, and one of the objects is to provide a high strength cold-rolled steel sheet exhibiting little variation in the mechanical property and a manufacturing method for the same (may be hereinafter referred to as the object 1). Also, another object of the invention of the present application is to provide a high strength cold-rolled steel sheet excellent in bendability while securing the tensile strength of 780 MPa or more, particularly 980 MPa or more and a manufacturing method for the same (may be hereinafter referred to as the object 2).

Solution to Problems

The invention described in claim 1 is a high strength cold-rolled steel sheet containing:

C: 0.05-0.30 mass %;
Si: 3.0 mass % or less (exclusive of 0 mass %);
Mn: 0.1-5.0 mass %;
P: 0.1 mass % or less (exclusive of 0 mass %);
S: 0.02 mass % or less (exclusive of 0 mass %);
Al: 0.01-1.0 mass %; and
N: 0.01 mass % or less (exclusive of 0 mass %) respectively, with the remainder consisting of iron and inevitable impurities, in which a microstructure includes ferrite that is a soft first phase by 20-50% in terms of area ratio, with the remainder consisting of tempered martensite and/or tempered bainite that is a hard second phase;

the difference between area ratio $V\alpha s$ of ferrite of a steel sheet surface layer section from the steel sheet surface to the depth of 100 μm and area ratio $V\alpha c$ of ferrite of the center section of t/4-3t/4 (t is the sheet thickness) $\Delta V\alpha = V\alpha s - V\alpha c$ is less than 10%; and the ratio of hardness Hvs of the steel sheet surface layer section and hardness Hvc of the center section RHv=Hvs/Hvc is 0.75-1.0.

The invention described in claim 2 is a high strength cold-rolled steel sheet containing:

C: 0.05-0.30 mass %;
Si: 3.0 mass % or less (exclusive of 0 mass %);
Mn: 0.1-5.0 mass %;

P: 0.1 mass % or less (exclusive of 0 mass %);

S: 0.02 mass % or less (exclusive of 0 mass %);

Al: 0.01-1.0 mass %; and

N: 0.01 mass % or less (exclusive of 0 mass %) respectively, with the remainder consisting of iron and inevitable impurities, in which a microstructure includes ferrite that is a soft first phase by 20-50% in terms of area ratio, with the remainder consisting of tempered martensite and/or tempered bainite that is a hard second phase;

the difference between area ratio $V\alpha s$ of ferrite of a steel sheet surface layer section from the steel sheet surface to the depth of 100 μm and area ratio $V\alpha c$ of ferrite of the center section of t/4-3t/4 (t is the sheet thickness) $\Delta V\alpha = V\alpha s - V\alpha c$ is 10-50%; and the average grain size of ferrite of the steel sheet surface layer section is 10 μm or less.

The invention described in claim 3 is the high strength cold-rolled steel sheet according to claim 1 or 2 further containing at least one group out of groups of (a)-(c) below.

(a) Cr: 0.01-1.0 mass %

(b) At least one element out of Mo: 0.01-1.0 mass %, Cu: 0.05-1.0 mass %, and Ni: 0.05-1.0 mass %

(c) At least one element out of Ca: 0.0001-0.01 mass %, Mg: 0.0001-0.01 mass %, Li: 0.0001-0.01 mass %, and REM: 0.0001-0.01 mass %.

The invention described in claim 4 is a manufacturing method for the high strength cold-rolled steel sheet described in claim 1 including the steps of hot rolling, thereafter cold rolling, thereafter annealing, and tempering with respective conditions illustrated in (A1)-(A4) below.

(A1) Hot rolling condition

Finish rolling temperature: $Ar_3$ point or above

Coiling temperature: above 600° C. and 750° C. or below (A2) Cold rolling condition Cold rolling ratio: more than 50% and 80% or less (A3) Annealing condition Holding at an annealing temperature of Ac1 or above and below (Ac1+Ac3)/2 for annealing holding time of 3,600 s or less, thereafter slow cooling with a first cooling rate of 1° C./s or more and less than 50° C./s from the annealing temperature to a first cooling completion temperature of 730° C. or below and 500° C. or above, and thereafter rapid cooling with a second cooling rate of 50° C./s or more to a second cooling completion temperature of Ms point or below.

(A4) Tempering condition

Tempering temperature: 300-500° C.

Tempering holding time: 60-1,200 s within the temperature range of 300° C.-tempering temperature The invention described in claim 5 is a manufacturing method for the high strength cold-rolled steel sheet described in claim 2 including the steps of hot rolling, thereafter pickling, cold rolling, thereafter annealing, and tempering with respective conditions illustrated in (B1)-(B4) below.

(B1) Hot rolling condition

Finish rolling temperature: $Ar_3$ point or above

Coiling temperature: 600-750° C.

(B2) Cold rolling condition

Cold rolling ratio: 20-50%

(B3) Annealing condition

Holding at an annealing temperature of (Ac1+Ac3)/2−Ac3 for annealing holding time of 3,600 s or less, thereafter slow cooling with a first cooling rate of 1° C./s or more and less than 50° C./s from the annealing temperature to a first cooling completion temperature of 730° C. or below and 500° C. or above, and thereafter rapid cooling with a second cooling rate of 50° C./s or more to a second cooling completion temperature of Ms point or below.

(B4) Tempering condition

Tempering temperature: 300-500° C.

Tempering holding time: 60-1,200 s within the temperature range of 300° C.-tempering temperature

Advantageous Effects of Invention

According to the invention of the present application, by controlling both of the difference in the ferrite area ratio and the hardness ratio of the steel sheet surface layer section and the center section to within a predetermined range in a dual-phase microstructure steel formed of ferrite that is the soft first phase and tempered martensite and/or tempered bainite that is the hard second phase, a high strength steel sheet exhibiting little variation in mechanical property and a manufacturing method for the same can be provided. Also, according to the present invention, by controlling the difference of the area ratio of ferrite between the steel sheet surface layer section and the center section to within a predetermined range and miniaturizing ferrite of the steel sheet surface layer section in a dual-phase microstructure steel formed of ferrite that is the soft first phase and tempered martensite and/or tempered bainite that is the hard second phase, a high strength steel sheet truly excellent in bendability while securing the tensile strength of 980 MPa or more and a manufacturing method for the same can be provided.

DESCRIPTION OF EMBODIMENTS

Figure 1:
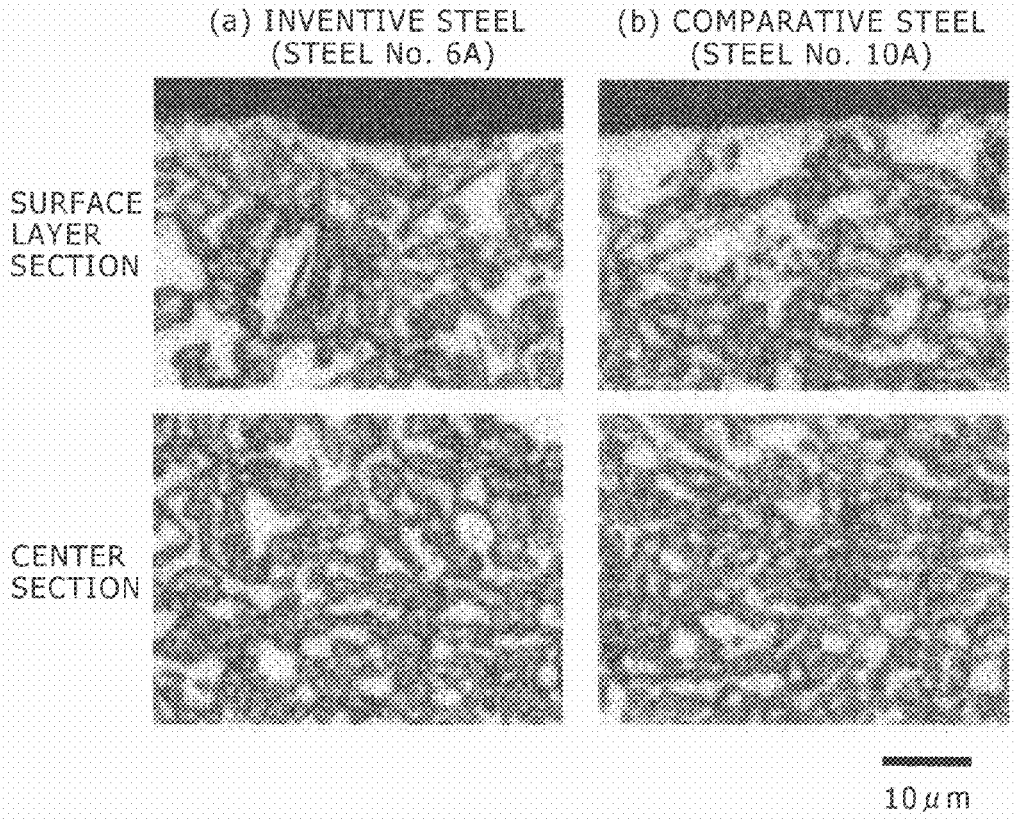
FIG. 1 shows photos of a cross-sectional microstructure of an inventive steel sheet and a comparative steel sheet in relation with the example 1.

In order to attain the object 1 and the object 2 described above, the inventors of the present application focused on a high strength steel sheet having a dual-phase microstructure formed of ferrite that was the soft first phase and tempered martensite and/or tempered bainite (may be hereinafter collectively referred to as "tempered martensite and the like") that was the hard second phase, and studied the ways and measures for reducing the variation in the mechanical property.

Below, the invention of the present application that attained the object 1 and the object 2 will be described one by one.

First, the invention of the present application that attained the object 1 (to provide a high strength cold-rolled steel sheet exhibiting little variation in the mechanical property and a manufacturing method for the same) will be described.

Also, in the description below, "the mechanical property" may be referred to as "the property" and "the variation in the mechanical property" may be referred to as "the property variation".

In order to suppress the property variation, from the viewpoint in a micro-state, it is effective to reduce the difference in the hardness between the soft first phase (may be simply referred to also as "the soft phase") and the hard second phase (may be simply referred to also as "the hard phase"). On the other hand, from the viewpoint in a macro-state, it is effective to reduce the difference in the property that is the difference in the material along the thickness direction of the steel sheet.

However, only with the viewpoint in a micro-state that is to reduce the difference in the hardness between the hard and soft phases, when the fraction of both phases changes due to the difference in the formability of the both phases, the property variation occurs as described in the prior art 4 described above.

Therefore, the inventors of the present application considered that the viewpoint in a macro-state that was to reduce the difference in the material in the steel sheet thickness direction was more effective in suppressing the property variation, and advanced the study with respect to the ways and measures for reducing the difference in the material in the steel sheet thickness direction.

As a concrete means, it is effective to equalize the fraction of the hard and soft phases constituting the surface layer section and the inside (the center section) and to equalize the hardness of the surface layer section and the inside (the center section) as much as possible.

By achieving such a microstructure, when the evaluation method for the property and the actual working method are the same, the same property can be exerted constantly.

However, to obtain such a microstructure as described above is difficult with general manufacturing methods of prior arts.

In order to manufacture such a microstructure form as described above, as an example, the following method is possible. That is to say, it is effective to combine coiling at a high temperature in hot rolling, high cold rolling ratio, and annealing on the low temperature side of the dual-phase range. First, by raising the coiling temperature after hot rolling, the size of the microstructure can be made large and uniform as a whole, and the microstructure formed only of two phases of ferrite+pearlite ($\alpha$+P) is effectively achieved. Next, by increasing the cold rolling ratio and executing strong working in cold rolling, the strain amount introduced to the surface layer section and the inside can be made generally equal to each other. When the cold rolling ratio is low, the strain of the surface layer section is liable to increase compared to the inside, and the strain amount is liable to be inclined along the steel sheet thickness direction. Although the strain amount is inclined along the steel sheet thickness direction even when the cold rolling ratio is increased, the effect thereof can be suppressed to minimal. Also, a high strain amount acts effectively in annealing of the next step. In other words, at the time of annealing, by imparting a high strain to all portions along the steel sheet thickness direction in cold rolling, nucleation of austenite is activated in heating, and a fine austenite microstructure can be obtained. Also, in soaking, ferrite precipitates from the grain boundary triple points of the fine austenite. Here, by making the soaking temperature the low temperature side of the dual-phase range, a microstructure formed of comparatively large ferrite of a similar size and fine austenite is formed. Therefore, by cooling, ferrite grows and becomes larger, and new ferrite comes to precipitate from the grain boundary triple points of fine austenite. Thus, by miniaturizing the microstructure before annealing, even though the temperature history is different between the surface layer section and the inside, nucleation of both of ferrite and austenite is activated, and therefore similar nucleation and growth behavior come to be exhibited. As a result, the fractions of the hard and soft phases of the surface layer section and the inside become generally equal to each other, and, because the microstructure size of both of the surface layer section and the inside becomes similar due to the forming process of the microstructure, the hardness also becomes generally the same.

The formability of the steel sheet having such a microstructure is generally the same under the same strain condition between the surface layer section and the inside, and excellent property stability comes to be exhibited.

Also, as a result of executing a proving test described in [example] below based on the thought experiment described above, a confirmatory evidence was obtained, therefore further studies were made, and the invention of the present application came to be completed.

First, the microstructure characterizing the inventive steel sheet will be described below.

[Microstructure of Inventive Steel Sheet]

Although the inventive steel sheet is based on the dual-phase microstructure formed of ferrite that is the soft first phase and tempered martensite and the like that is the hard second phase as described above, it is characterized in the point that the difference in the ferrite fraction and the hardness ratio between the steel sheet surface section and the center section is controlled in particular.

<Ferrite that is Soft First Phase: 20-50% in Terms of Area Ratio>

In the dual-phase microstructure steel such as ferrite-tempered martensite and the like, deformation is handled mainly by ferrite that has high deformability. Therefore, the elongation of the dual-phase microstructure steel such as ferrite-tempered martensite and the like is determined mainly by the area ratio of ferrite.

In order to secure the target elongation, the area ratio of ferrite should be 20% or more (preferably 25% or more, and more preferably 30% or more). However, when ferrite becomes excessive, the strength cannot be secured, and therefore the area ratio of ferrite is made 50% or less (preferably 45% or less, and more preferably 40% or less).

<Difference Between Area Ratio $V\alpha s$ of Ferrite of Steel Sheet Surface Layer Section from Steel Sheet Surface to Depth of 100 μm and Area Ratio $V\alpha c$ of Ferrite of Center Section of t/4-3t/4 (t is the Sheet Thickness) $\Delta V\alpha = V\alpha s - V\alpha c$: Less than 10%>

The reason for setting the above condition is that, by equalizing the ferrite fraction of the steel sheet surface layer section and the inside as much as possible, the hardness of the steel sheet surface layer section and the inside described below is equalized, the material is made uniform along the steel sheet thickness direction in a macro-state, and the property variation is suppressed. In order to obtain the above effect, the difference $\Delta V\alpha$ of the area ratio of ferrite between the steel sheet surface layer section and the center section should be less than 10% (preferably 8% or less, and more preferably 6% or less).

Here, the reason the steel sheet surface layer section is limited to the portion from the steel sheet surface to the depth of 100 μm is that the portion is the region where the microstructure form is particularly liable to change by a general manufacturing method.

<Ratio of Hardness Hvs of the Steel Sheet Surface Layer Section and Hardness Hvc of the Center Section RHv=Hvs/Hvc: 0.75-1.0>

The reason for setting the above condition is that, by equalizing the hardness of the steel sheet surface layer section and the center section as much as possible, the ferrite fraction of the steel sheet surface layer section and the inside described above is equalized, the material is made uniform along the steel sheet thickness direction in a macro-state, and the property variation is suppressed. In order to obtain the above effect, the hardness ratio RHv should be 0.75 or more (preferably 0.77 or more, and more preferably 0.79 or more). However, when the hardness ratio RHv exceeds 1.0, if the surface layer section becomes harder than the inside as a case of executing sintering treatment for example, the variation in the property increases adversely.

Below, respective measuring methods for the area ratio of each phase in the entire thickness of the steel sheet, the area ratio of ferrite in the steel sheet surface layer section and the center section, and the hardness in the steel sheet surface layer section and the center section will be described.

[Measuring Method for Area Ratio of Each Phase Over Entire Thickness of Steel Sheet]

First, with respect to the area ratio of each phase over the entire thickness of the steel sheet, each specimen steel sheet was mirror-polished and was corroded by a 3% nital solution to expose the metal microstructure, the scanning electron microscope (SEM) image was thereafter observed under 2,000 magnifications with respect to 5 fields of view of approximately 40 μm×30 μm region, 100 points were measured per one field of view by the point counting method, the area of each ferrite grain was obtained, and the area of ferrite was obtained by adding them together. Also, by the image analysis, the region including cementite was defined as tempered martensite and/or tempered bainite (hard second phase), and the remaining region was defined as retained austenite, martensite, and the mixture microstructure of retained austenite and martensite. Further, from the area percentage of each region, the area ratio of each phase was calculated.

[Area Ratio of Ferrite in Steel Sheet Surface Layer Section and Center Section]

Also, with respect to the area ratio of ferrite in the center section, in the range of t/4-3t/4 (t is the sheet thickness), the area ratio of ferrite was obtained similarly to [Measuring method for area ratio of each phase over entire thickness of steel sheet] described above.

On the other hand, with respect to the area ratio of ferrite in the steel sheet surface layer section, in the range from the steel sheet surface to the depth of 30 μm, the area ratio of ferrite was obtained similarly to [Measuring method for area ratio of each phase over entire thickness of steel sheet] described above with respect to 5 fields of view of approximately 40 μm×30 μm region.

[Measuring Method for Hardness in Steel Sheet Surface Layer Section and Center Section]

Further, with respect to the hardness in the steel sheet surface layer section and the center section, in the sheet thickness cross section parallel to the rolling direction, at the position of 0.05 mm depth from the steel sheet surface for the steel sheet surface layer section and at the position of t/4 (t is the sheet thickness) for the center section, the hardness of five points along the direction orthogonal to the sheet thickness direction was each measured using a Vickers hardness tester in the condition of the 100 g load, and the hardness was obtained by arithmetically averaging the measured values of these five points.

Next, the chemical composition constituting the inventive steel sheet of the present application will be described. Below, all units of the chemical composition are mass %.

[Chemical Composition of Inventive Steel Sheet]

C: 0.05-0.30%

C is an important element affecting the area ratio of the hard second phase and the area ratio of ferrite, and affecting the strength, elongation and stretch flange formability. When C content is less than 0.05%, the strength cannot be secured. On the other hand, when C content exceeds 0.30%, the weldability deteriorates. The range of C content is preferably 0.10-0.25%, and more preferably 0.14-0.20%.

Si: 3.0% or less (exclusive of 0%)

Si is a useful element having an effect of suppressing coarsening of the cementite grain in tempering, and contributing to fulfilment of both of elongation and stretch flange formability. When Si content exceeds 3.0%, formation of austenite in heating is impeded, therefore the area ratio of the hard second phase cannot be secured, and stretch flange formability cannot be secured. The range of Si content is preferably 0.50-2.5%, and more preferably 1.0-2.2%.

Mn: 0.1-5.0%

In addition to having an effect of suppressing coarsening of cementite in tempering similarly to Si described above, Mn contributes to fulfilment of both of elongation and stretch flange formability by increasing formability of the hard second phase. Further, there is also an effect of widening the range of the manufacturing condition for obtaining the hard second phase by enhancing quenchability. When Mn content is less than 0.1%, the effects described above cannot be sufficiently exerted, therefore fulfilment of both of elongation and stretch flange formability cannot be achieved, whereas when Mn content exceeds 5.0%, the reverse transformation temperature becomes excessively low, recrystallization cannot be effected, and therefore the balance of the strength and elongation cannot be secured. The range of Mn content is preferably 0.5-2.5%, and more preferably 1.2-2.2%.

P: 0.1% or less (exclusive of 0%)

Although P inevitably exists as an impurity element and contributes to increase of the strength by solid solution strengthening, because P deteriorates stretch flange formability by segregating on the prior austenite grain boundary and embrittling the grain boundary, P content is made 0.1% or less, preferably 0.05% or less, and more preferably 0.03% or less.

S: 0.02% or less (exclusive of 0%)

S also inevitably exists as an impurity element and deteriorates stretch flange formability by forming MnS inclusions and becoming an origin of a crack in enlarging a hole, and therefore S content is made 0.02% or less, preferably 0.018% or less, and more preferably 0.016% or less.

Al: 0.01-1.0%

Al is added as a deoxidizing element, and has an effect of miniaturizing the inclusions. Also, by joining with N to form AlN and reducing solid solution N that contributes to generation of strain aging, Al prevents deterioration of elongation and stretch flange formability. When Al content is less than 0.01%, because solid solution N remains in steel, strain aging occurs, and elongation and stretch flange formability cannot be secured. On the other hand, when Al content exceeds 1.0%, because Al impedes formation of austenite in heating, the area ratio of the hard second phase cannot be secured, and stretch flange formability cannot be secured.

N: 0.01% or less (exclusive of 0%)

N also inevitably exists as an impurity element and deteriorates elongation and stretch flange formability by strain aging, and therefore N content is preferable to be as less as possible, and is made 0.01% or less.

The steel of the invention of the present application basically contains the composition described above, and the remainder is substantially iron and impurities. However, other than the above, allowable compositions described below can be added within a range not impairing the action of the invention of the present application.

Cr: 0.01-1.0%

Cr is a useful element that can improve stretch flange formability by suppressing growth of cementite. When Cr is added by less than 0.01%, the action as described above cannot be effectively exerted, whereas when Cr is added exceeding 1.0%, coarse $Cr_7C_3$ comes to be formed, and stretch flange formability deteriorates.

At least one element out of

Mo: 0.01-1.0%,

Cu: 0.05-1.0%, and

Ni: 0.05-1.0%

These elements are elements useful in improving the strength without deteriorating formability by solid solution strengthening. When respective elements are added by less than respective lower limit values described above, the action as described above cannot be effectively exerted, whereas when respective elements are added exceeding 1.0%, the cost increases excessively.

At least one element out of

Ca: 0.0001-0.01%,

Mg: 0.0001-0.01%,

Li: 0.0001-0.01%, and

REM: 0.0001-0.01%

These elements are elements useful in improving stretch flange formability by miniaturizing inclusions and reducing an origin of fracture. When respective elements are added by less than 0.0001%, the action as described above cannot be effectively exerted, whereas when respective elements are added exceeding 0.01%, the inclusions are coarsened adversely, and stretch flange formability deteriorates.

Also, REM means rare earth metals which are 3A group elements in the periodic table.

Next, a manufacturing method for obtaining the inventive steel sheet described above will be described below.

[Manufacturing Method for Inventive Steel Sheet]

In order to manufacture such a cold-rolled steel sheet as described above, first, steel having the chemical composition as described above is smelted, is made into a slab by blooming or continuous casting, is thereafter hot-rolled, is pickled, and is cold-rolled.

[Hot Rolling Condition]

With respect to the hot rolling condition, it is preferable to set the finish rolling temperature at Ar3 point or above, to execute cooling properly, and to execute coiling thereafter in a range of 600-750° C.

<Coiling Temperature: Above 600° C. and 750° C. or Below>

By making the coiling temperature 600° C. or above (preferably 620° C. or above, and particularly preferably 640° C. or above) which is on the higher side, the size of the microstructure can be made large and uniform as a whole, and the microstructure formed only of two phases of ferrite+pearlite (α+P) is achieved. However, when the coiling temperature is made excessively high, the microstructure size of the hot-rolled sheet becomes excessively large, and therefore the coiling temperature is made 750° C. or below (preferably 730° C. or below, and particularly preferably 710° C. or below).

[Cold Rolling Condition]

With respect to the cold rolling condition, it is preferable to make the cold rolling ratio in the range of more than 50% and 80% or less.

<Cold Rolling Ratio: More than 50% and 80% or Less>

By making the cold rolling ratio more than 50% (preferably 55% or more), the strain amount introduced to the surface layer section and the inside can be made generally equal by executing strong working in cold rolling. However, when the cold rolling ratio is made excessively high, the deformation resistance in cold rolling becomes excessively high, the rolling speed is lowered, thereby the productivity extremely deteriorates, and therefore the cold rolling ratio is made 80% or less (preferably 75% or less).

Also, after the cold rolling, annealing and tempering are executed subsequently.

[Annealing Condition]

With respect to the annealing condition, it is preferable to hold for the annealing holding time of 3,600 s or less at the annealing temperature of Ac1 or above and below (Ac1+Ac3)/2, to execute slow cooling thereafter with the first cooling rate (slow cooling rate) of 1° C./s or more and less than 50° C./s from the annealing temperature to the first cooling completion temperature (slow cooling completion temperature) of 730° C. or below and 500° C. or above, and to execute rapid cooling thereafter with the second cooling rate (rapid cooling rate) of 50° C./s or more to the second cooling completion temperature (rapid cooling completion temperature) of Ms point or below.

<Holding for Annealing Holding Time of 3,600 s or Less at Annealing Temperature of Ac1 or Above and Below (Ac1+Ac3)/2>

The reason for setting the above condition is that, by soaking on the low temperature side of the dual-phase range, a microstructure formed of comparatively large ferrite of a uniform size and fine austenite is to be formed.

When the annealing temperature is below Ac1, transformation into austenite is not effected, the predetermined dual-phase microstructure is not obtained, whereas when the annealing temperature becomes (Ac1+Ac3)/2 or above, ferrite in the surface layer section grows excessively, the difference in the ferrite fraction and the hardness between the surface layer section and the inside becomes excessive, and the variation in the property increases.

Also, when the annealing holding time exceeds 3,600 s, the productivity extremely deteriorates which is not preferable. Preferable lower limit of the annealing holding time is 60 s. By extending the heating time, the strain within ferrite can be further removed.

<Slow Cooling with First Cooling Rate of 1° C./s or More and Less than 50° C./s to First Cooling Completion Temperature of 730° C. or Below and 500° C. or Above>

The reason for setting the above condition is that, by making the size of ferrite nucleated at the time of the start of cooling a size generally same to that of ferrite formed in the dual-phase range described above and forming the ferrite microstructure having 20-50% in terms of the area ratio combining them, the elongation is made capable of being improved while securing stretch flange formability.

At the temperature below 500° C. or with the cooling rate of less than 1° C./s, ferrite is formed excessively, and the elongation and stretch flange formability cannot be secured.

<Rapid Cooling with Second Cooling Rate of 50° C./s or More to Second Cooling Completion Temperature of Ms Point or Below>

The reason for setting the above condition is that, ferrite is to be suppressed from being formed from austenite during cooling, and the hard second phase is to be obtained.

When rapid cooling is finished at a temperature higher than Ms point or the cooling rate becomes less than 50° C./s, bainite is formed excessively, and the strength of the steel sheet cannot be secured.

[Tempering Condition]

With respect to the tempering condition, it is preferable to execute heating from the temperature after annealing cooling described above to the tempering temperature: 300-500°

C., to be held within the temperature range of 300° C.-tempering temperature for the tempering holding time: 60-1,200 s, and to execute cooling thereafter.

The reason for setting the above condition is that, while the solid solution C concentrated into ferrite in annealing described above is made to remain in ferrite as it is even after tempering is effected and the hardness of ferrite is increased, C is to be made to precipitate as cementite further in tempering from the hard second phase where C content has dropped as a reaction of concentration of the solid solution C into ferrite in annealing described above, the fine cementite grains are to be coarsened, and the hardness of the hard second phase is to be lowered.

When the tempering temperature is below 300° C. or the tempering time is less than 60 s, the heating state of the surface and the inside becomes non-uniform, the hardness difference between the surface and the inside increases, and thereby the property variation increases. On the other hand, when the tempering temperature exceeds 500° C., the hard second phase is softened excessively and the strength cannot be secured, or cementite is coarsened excessively and stretch flange formability deteriorates. Also, when the tempering time exceeds 1,200 s, the productivity lowers, which is not preferable.

Preferable range of the tempering temperature is 320-480° C., and preferable range of the tempering holding time is 120-600 s.

Next, the invention of the present application which attained the object 2 described above (to provide a high strength cold-rolled steel sheet excellent in bendability and a manufacturing method for the same) will be described.

The point that becomes an origin of fracture in bending work mainly is the boundary face between the soft phase and the hard phase. Therefore, as one of the means for improving the bendability, a method for reducing the difference in the hardness between the soft phase and the hard phase is conceivable.

However, even when the difference in the hardness between the both phases is reduced, because the deformability of the soft phase and the hard phase is different essentially, significant improvement effect of the bendability cannot be obtained only by simply reducing the difference in the hardness of the both phases.

The present inventors considered that the bendability was controlled by the balance of the ductility of a phase and restriction of deformation from a phase surrounding the same.

More specifically, in the high strength steel sheet of prior arts, because the hard phase around the soft phase that had a role of ductility restricted deformation of the soft phase, the soft phase could not fully exert ductility, as a result, peeling off occurred in the boundary face between the soft phase and the hard phase, and sufficient bendability was not obtained.

Therefore, in order to relax this restriction of the soft phase by the hard phase, it is conceivable to increase the rate of the soft phase and reduce the hard phase. However, in order to secure the strength, presence of the hard phase of a certain degree is necessary. In order to achieve both of them, the rate of the soft phase was inclined between the steel sheet surface layer section (may be hereinafter simply referred to also as "surface layer section") and the inside (center section).

According to the prior arts 5, 6 described above, the soft phase in the vicinity of the surface was increased by decarburization in annealing, however, according to this method, because the microstructure of the surface layer section and the inside extremely differs from each other, excellent bendability cannot be secured.

Therefore, the rate of the soft phase was inclined between the surface layer section and the inside by a method described below.

First, by making the hot rolling finishing temperature (coiling temperature) the higher side (600-750° C.), grain boundary oxidation is caused in the surface layer section of the hot-rolled sheet. Next, by removing this grain boundary oxidation by pickling, the unevenness is formed on the surface. Thereafter, by cold rolling, by the portion the unevenness is formed on the surface, more strain is introduced to the vicinity of the surface, and, as a result, strain distribution can be formed from the surface layer section over to the inside. However, when the cold rolling ratio is excessively high, the effect by the unevenness described above cannot be secured, the strain is introduced uniformly, and therefore the cold rolling ratio should be within a proper range (20-50%).

In the surface layer section to which much strain has been introduced, austenitic transformation is promoted in annealing heating, much austenite is nucleated, and fine ferrite remains between the fine austenite described above. Further, in soaking and slow cooling also, more ferrite is nucleated from the fine austenite.

As a result, in the surface layer section, ferrite becomes fine and the ferrite fraction also can be increased compared to the inside.

When the steel sheet having such a microstructure is subjected to bending work, the surface layer section is subjected to severer tensile and compressive deformation compared to the inside, however, because of the effect of miniaturization and increase of the soft phase, excellent bendability comes to be exhibited.

Also, as a result of executing a proving test described in [example] below based on the thought experiment described above, a confirmatory evidence was obtained, therefore further studies were made, and the present invention came to be completed.

First, the microstructure characterizing the inventive steel sheet will be described below.

[Microstructure of Inventive Steel Sheet]

Although the steel sheet of the invention is based on the dual-phase microstructure formed of ferrite that is the soft first phase and tempered martensite and the like that is the hard second phase as described above, it is characterized in the point that the difference of the ferrite fraction between the steel sheet surface section and the center section and the ferrite grain size of the steel sheet surface section are controlled in particular.

<Ferrite that is Soft First Phase: 20-50% in Terms of Area Ratio>

In the dual-phase microstructure steel such as ferrite-tempered martensite and the like, deformation is handled mainly by ferrite that has high deformability. Therefore, the elongation of the dual-phase microstructure steel such as ferrite-tempered martensite and the like is determined mainly by the area ratio of ferrite.

In order to secure the target elongation, the area ratio of ferrite should be 20% or more (preferably 25% or more, and more preferably 30% or more). However, when ferrite becomes excessive, the strength cannot be secured, and therefore the area ratio of ferrite is made 50% or less (preferably 45% or less, and more preferably 40% or less).

<Difference Between Area Ratio $V\alpha s$ of Ferrite of Steel Sheet Surface Layer Section from Steel Sheet Surface to Depth of 100 μm and Area Ratio Vαc of Ferrite of Center Section of t/4-3t/4 (t is the Sheet Thickness) ΔVα=Vαs−Vαc: 10-50%>

The reason for setting above condition is that, by making the area ratio of ferrite in the steel sheet surface layer section higher than that of the inside, the tensile and compressive stress applied to the surface layer section in bending work is to be relaxed and the bendability is to be improved. When the difference ΔVα of the area ratio of ferrite between the steel sheet surface layer section and the center section is less than 10%, the relaxing action of the tensile and compressive stress applied to the surface layer section is not sufficiently exerted, and the improvement effect of the bendability cannot be secured. On the other hand, when ΔVα exceeds 50%, the ferrite grain size is liable to become non-uniform, and the bendability deteriorates. Preferable range of ΔVα is 15-45%, and more preferable range is 20-40%.

Here, the reason the steel sheet surface layer section is limited to the portion from the steel sheet surface to the depth of 100 μm is that, when ferrite is increased to the depth exceeding 100 μm, it becomes hard to secure the strength.

<Average Grain Size of Ferrite of the Steel Sheet Surface Layer Section: 10 μm or Less>

The reason for setting above condition is that, by miniaturizing ferrite of the steel sheet surface layer section, the size of the ferrite grain is to be made uniform and the bendability is to be improved. When the average grain size of ferrite of the steel sheet surface layer section exceeds 10 μm, the bendability deteriorates. Preferable range of the average grain size of ferrite described above is 9 μm or less, and more preferable range is 8 μm or less.

Below, respective measuring methods for the area ratio of each phase over the entire steel sheet thickness, the area ratio of ferrite in the steel sheet surface layer section and the center section, and the average grain size of ferrite in the steel sheet surface layer section will be described.

[Measuring Method for Area Ratio of Each Phase Over Entire Steel Sheet Thickness]

First, with respect to the area ratio of each phase over the entire steel sheet thickness, each specimen steel sheet was mirror-polished and was corroded by a 3% nital solution to expose the metal microstructure, the scanning electron microscope (SEM) image was thereafter observed under 2,000 magnifications with respect to 5 fields of view of approximately 40 μm×30 μm region, 100 points were measured per one field of view by the point counting method, the area of each ferrite grain was obtained, and the area of ferrite was obtained by adding them together. Also, by the image analysis, the region including cementite was defined as tempered martensite and/or tempered bainite (hard second phase), and the remaining region was defined as retained austenite, martensite, and the mixture microstructure of retained austenite and martensite. Further, from the area percentage of each region, the area ratio of each phase was calculated.

[Area Ratio of Ferrite in Steel Sheet Surface Layer Section and Center Section]

Also, with respect to the area ratio of ferrite in the center section, in the range of t/4-3t/4 (t is the sheet thickness), the area ratio of ferrite was obtained similarly to [Measuring method for area ratio of each phase over entire thickness of steel sheet] described above.

On the other hand, with respect to the area ratio of ferrite in the steel sheet surface layer section, in the range from the steel sheet surface to the depth of 30 μm, the area ratio of ferrite was obtained similarly to [Measuring Method for Area Ratio of Each Phase in Entire Thickness of Steel Sheet] Described Above with Respect to 5 Fields of View of Approximately 40 μm×30 μm Region.

[Measuring Method for Average Grain Size of Ferrite in Steel Sheet Surface Layer Section]

From the area of each ferrite grain measured in measuring the area ratio of ferrite in the steel sheet surface layer section described above, the equivalent circle diameter was calculated.

Next, a manufacturing method for obtaining the inventive steel sheet described above will be described below.

[Manufacturing Method for Inventive Steel Sheet]

In order to manufacture such a cold-rolled steel sheet as described above, first, steel having the chemical composition as described above is smelted, is made into a slab by blooming or continuous casting, is thereafter hot-rolled, is pickled, and is cold-rolled.

[Hot Rolling Condition]

With respect to the hot rolling condition, it is preferable to set the finish rolling temperature at $Ar_3$ point or above, to execute cooling properly, and to execute coiling thereafter in a range of 600-750° C.

<Coiling Temperature: 600-750° C.>

The reason for setting the above condition is that, by making the coiling temperature 600° C. or above (preferably 610° C. or above) which is on the higher side, grain boundary oxidation is to be caused in the surface layer section of the hot-rolled sheet. After forming the unevenness on the surface by removing this grain boundary oxidation by pickling in a step to follow, cold rolling is executed, thereby more strain is introduced to the vicinity of the surface, and, by further executing annealing, ferrite of the surface layer section can be miniaturized and increased. However, when the coiling temperature is made excessively high, the microstructure size of the hot-rolled sheet becomes excessively large, and therefore the coiling temperature is made 750° C. or below (preferably 700° C. or below).

[Cold Rolling Condition]

With respect to the cold rolling condition, it is preferable to make the cold rolling ratio in the range of 20-50%.

<Cold Rolling Ratio: 20-50%>

The reason for setting the above condition is that, by making the cold rolling ratio 20% or more (preferably 30% or more), more strain is to be introduced to the vicinity of the surface utilizing the unevenness on the steel sheet surface formed by removing grain boundary oxidation by pickling. However, when the cold rolling ratio is made excessively high, the strain is introduced uniformly, and therefore the cold rolling ratio is made 50% or less (preferably 45% or less).

Also, after the cold rolling, annealing and tempering are executed subsequently.

[Annealing Condition]

With respect to the annealing condition, it is preferable to hold for the annealing holding time of 3,600 s or less at the annealing temperature of (Ac1+Ac3)/2−Ac3, to execute slow cooling thereafter with the first cooling rate (slow cooling rate) of 1° C./s or more and less than 50° C./s from the annealing temperature to the first cooling completion temperature (slow cooling completion temperature) of 730° C. or below and 500° C. or above, and to execute rapid cooling thereafter with the second cooling rate (rapid cooling rate) of 50° C./s or more to the second cooling completion temperature (rapid cooling completion temperature) of Ms point or below.

<Holding for Annealing Holding Time of 3,600 s or Less at Annealing Temperature of (Ac1+Ac3)/2−Ac3>

The reason for setting the above condition is that, by holding on the high temperature side of the dual-phase range, austenite is to be easily nucleated, fine ferrite is made to remain, the region of 50% or more in terms of the area ratio is to be transformed into austenite, and thereby the hard second phase of a sufficient amount is to be transformingly formed in cooling thereafter.

When the annealing temperature is below (Ac1+Ac3)/2, austenitic transformation amount is insufficient, ferrite is liable to be coarsened, and therefore the ductility deteriorates. On the other hand, when the annealing temperature exceeds Ac3, ferrite is coarsened, the difference of the fraction between the surface layer and the inside cannot be obtained, and therefore the ductility deteriorates.

Also, when the annealing holding time exceeds 3,600 s, the productivity extremely deteriorates, which is not preferable. Preferable lower limit of the annealing holding time is 60 s. By extending the heating time, the strain within ferrite can be further removed.

<Slow Cooling with First Cooling Rate of 1° C./s or More and Less than 50° C./s to First Cooling Completion Temperature of 730° C. or Below and 500° C. or Above>

The reason for setting the above condition is that, by making the size of ferrite nucleated at the time of the start of cooling a size generally the same to that of ferrite formed in the dual-phase range described above and forming the ferrite microstructure having 20-50% in terms of the area ratio combining them, the elongation can be improved in a state stretch flange formability is secured.

At the temperature below 500° C. or with the cooling rate of less than 1° C./s, ferrite is formed excessively, and the elongation and stretch flange formability cannot be secured.

<Rapid Cooling with Second Cooling Rate of 50° C./s or More to Second Cooling Completion Temperature of Ms Point or Below>

The reason for setting the above condition is that, ferrite is to be suppressed from being formed from austenite during cooling, and the hard second phase is to be obtained.

When rapid cooling is finished at a temperature higher than Ms point or the cooling rate becomes less than 50° C./s, bainite is formed excessively, and the strength of the steel sheet cannot be secured.

[Tempering Condition]

In order to secure the tensile strength of 980 MPa or more, the tempering temperature is made 500° C. or below. Further, although the strength increases when the tempering temperature is low, because the elongation and the hole expansion ratio (stretch flange formability) deteriorate, the tempering temperature is made 300° C. or above. Also, the tempering holding time then is made 60-1,200 s, and cooling can be executed thereafter.

Further, the chemical composition constituting the steel sheet of the invention of the present application that attained the object 2 described above is similar to that of the high strength cold-rolled steel sheet of the invention of the present application that attained the object 1 described above.

EXAMPLE

Example 1

Example in Relation with the Invention of the Present Application that Attained the Object 1 Described Above Steel having various composition was smelted as illustrated in Table 1 and Table 2 below, and an ingot with 120 mm thickness was manufactured. The ingot was hot-rolled to 25 mm thickness, was thereafter hot-rolled again to 3.2 mm thickness under various manufacturing conditions illustrated in Tables 3-5 below, was pickled, was thereafter cold-rolled further to 1.6 mm thickness, and was thereafter subjected to a heat treatment.

Also, Ac1 and Ac3 in Table 1 were obtained using the formula 1 and the formula 2 below (refer to "The Physical Metallurgy of Steels", Leslie, Translation Supervisor: KOHDA Shigeyasu, Maruzen Company, Limited (1985), p. 273).

$$Ac1(°\ C.)=723+29.1[Si]-10.7[Mn]+16.9[Cr]-16.9[Ni] \quad \text{Formula 1}$$

$$Ac3(°\ C.)=910-203\sqrt{[C]}+44.7[Si]+31.5[Mo]-15.2[Ni] \quad \text{Formula 2}$$

where [ ] represents the content (mass %) of each element.

TABLE 1

| Steel | Chemical composition (mass %) [Remainder: Fe and inevitable impurities] | | | | | | | | Ac1 | Ac3 | (Ac1 + Ac3)/2 |
|---|---|---|---|---|---|---|---|---|---|---|---|
| kind | C | Si | Mn | P | S | Al | N | Others | (° C.) | (° C.) | (° C.) |
| 1 | 0.19 | 1.22 | 0.85 | 0.004 | 0.002 | 0.046 | 0.0042 | — | 749 | 876 | 813 |
| 2 | 0.18 | 1.40 | 1.83 | 0.003 | 0.004 | 0.044 | 0.0045 | — | 744 | 886 | 815 |
| 3 | 0.17 | 3.08 | 1.50 | 0.002 | 0.006 | 0.047 | 0.0041 | — | 797 | 964 | 880 |
| 4 | 0.15 | 0.78 | 1.84 | 0.002 | 0.012 | 0.089 | 0.0052 | Ca: 0.0010, REM: 0.0005 | 726 | 866 | 796 |
| 5 | 0.20 | 1.26 | 1.92 | 0.003 | 0.004 | 0.042 | 0.0036 | Ni: 0.38, Ca: 0.0004 | 733 | 870 | 801 |
| 6 | 0.33 | 1.20 | 1.60 | 0.002 | 0.004 | 0.044 | 0.0043 | — | 741 | 847 | 794 |
| 7 | 0.18 | 1.16 | 1.52 | 0.035 | 0.004 | 0.039 | 0.0015 | Cu: 0.61, Ca: 0.0007 | 740 | 876 | 808 |
| 8 | 0.20 | 1.22 | 2.55 | 0.005 | 0.004 | 0.035 | 0.0047 | Ca: 0.0010 | 731 | 874 | 802 |
| 9 | 0.21 | 1.31 | 3.89 | 0.008 | 0.001 | 0.047 | 0.0049 | Ca: 0.0012 | 719 | 876 | 798 |
| 10 | 0.13 | 1.68 | 1.42 | 0.003 | 0.004 | 0.039 | 0.0043 | Cu: 0.95 | 757 | 912 | 834 |
| 11 | 0.19 | 1.26 | 2.07 | 0.001 | 0.010 | 0.035 | 0.0044 | Ni: 0.06, Li: 0.0004 | 737 | 877 | 807 |
| 12 | 0.17 | 0.56 | 2.09 | 0.002 | 0.004 | 0.037 | 0.0041 | Ca: 0.0016 | 717 | 851 | 784 |
| 13 | 0.18 | 1.89 | 1.61 | 0.001 | 0.001 | 0.053 | 0.0027 | Mg: 0.0003 | 761 | 908 | 835 |
| 14 | 0.20 | 1.32 | 0.08 | 0.002 | 0.004 | 0.065 | 0.0072 | — | 760 | 878 | 819 |
| 15 | 0.23 | 1.35 | 5.44 | 0.001 | 0.002 | 0.043 | 0.0063 | — | 704 | 873 | 789 |
| 16 | 0.04 | 1.31 | 1.80 | 0.007 | 0.001 | 0.025 | 0.0030 | — | 742 | 928 | 835 |
| 17 | 0.09 | 1.27 | 1.57 | 0.002 | 0.003 | 0.036 | 0.0045 | Mo: 0.65, Ca: 0.0005, Mg: 0.0018, Li: 0.0024 | 743 | 926 | 835 |
| 18 | 0.28 | 0.95 | 2.14 | 0.003 | 0.016 | 0.039 | 0.0042 | — | 728 | 845 | 786 |
| 19 | 0.26 | 1.30 | 1.80 | 0.001 | 0.001 | 0.035 | 0.0046 | — | 742 | 865 | 803 |
| 20 | 0.21 | 1.17 | 1.81 | 0.003 | 0.008 | 0.031 | 0.0028 | Ni: 0.64, Ca: 0.0006 | 727 | 860 | 793 |

TABLE 1-continued

| Steel | Chemical composition (mass %) [Remainder: Fe and inevitable impurities] | | | | | | | | Ac1 | Ac3 | (Ac1 + Ac3)/2 |
|---|---|---|---|---|---|---|---|---|---|---|---|
| kind | C | Si | Mn | P | S | Al | N | Others | (° C.) | (° C.) | (° C.) |
| 21 | 0.20 | 1.19 | 1.54 | 0.001 | 0.004 | 0.046 | 0.0032 | — | 741 | 872 | 807 |
| 22 | 0.19 | 1.19 | 0.41 | 0.003 | 0.003 | 0.043 | 0.0054 | Ca: 0.0003 | 753 | 875 | 814 |
| 23 | 0.21 | 1.37 | 1.42 | 0.010 | 0.002 | 0.032 | 0.0041 | Mg: 0.0014 | 748 | 878 | 813 |
| 24 | 0.19 | 1.38 | 1.37 | 0.002 | 0.001 | 0.012 | 0.0049 | Cr: 0.08, Li: 0.0018 | 750 | 883 | 817 |
| 25 | 0.22 | 1.23 | 1.84 | 0.002 | 0.003 | 0.046 | 0.0049 | — | 739 | 870 | 804 |
| 26 | 0.15 | 1.43 | 1.72 | 0.002 | 0.002 | 0.037 | 0.0039 | — | 746 | 895 | 821 |

(Underline: out of range of invention of present application, —: less than detection limit)

TABLE 2

(Continued from Table 1)

| Steel | Chemical composition (mass %) [Remainder: Fe and inevitable impurities] | | | | | | | | Ac1 | Ac3 | (Ac1 + Ac3)/2 |
|---|---|---|---|---|---|---|---|---|---|---|---|
| kind | C | Si | Mn | P | S | Al | N | Others | (° C.) | (° C.) | (° C.) |
| 27 | 0.21 | 1.37 | 1.57 | 0.018 | 0.005 | 0.040 | 0.0084 | — | 746 | 878 | 812 |
| 28 | 0.16 | 1.42 | 1.60 | 0.003 | 0.002 | 0.044 | 0.0043 | — | 747 | 892 | 820 |
| 29 | 0.16 | 1.29 | 1.61 | 0.003 | 0.001 | 0.039 | 0.0032 | Mo: 0.09 | 743 | 889 | 816 |
| 30 | 0.17 | 1.20 | 2.12 | 0.001 | 0.002 | 0.032 | 0.0054 | Ca: 0.0008 | 735 | 880 | 808 |
| 31 | 0.16 | 1.33 | 2.13 | 0.014 | 0.005 | 0.038 | 0.0029 | Ca: 0.0009, REM: 0.0012 | 739 | 888 | 814 |
| 32 | 0.18 | 0.09 | 1.97 | 0.003 | 0.002 | 0.043 | 0.0032 | Mo: 0.81, Ca: 0.0007 | 705 | 853 | 779 |
| 33 | 0.17 | 1.28 | 0.59 | 0.001 | 0.019 | 0.036 | 0.0048 | Cu: 0.15, Ca: 0.0006 | 754 | 884 | 819 |
| 34 | 0.20 | 1.29 | 1.87 | 0.003 | 0.005 | 0.079 | 0.0033 | Ca: 0.0008 | 741 | 877 | 809 |
| 35 | 0.17 | 1.23 | 1.86 | 0.003 | 0.001 | 0.037 | 0.0083 | Mo: 0.26 | 739 | 889 | 814 |
| 36 | 0.15 | 1.26 | 2.08 | 0.001 | 0.002 | 0.037 | 0.0037 | Ca: 0.0004 | 737 | 888 | 813 |
| 37 | 0.18 | 1.27 | 1.17 | 0.002 | 0.001 | 0.032 | 0.0048 | — | 747 | 881 | 814 |
| 38 | 0.24 | 2.73 | 1.48 | 0.006 | 0.005 | 0.034 | 0.0008 | Cr: 0.29, Ca: 0.0012 | 792 | 933 | 862 |
| 39 | 0.16 | 1.33 | 1.88 | 0.002 | 0.006 | 0.041 | 0.0039 | Ca: 0.0007 | 742 | 888 | 815 |
| 40 | 0.18 | 2.07 | 3.91 | 0.025 | 0.005 | 0.033 | 0.0041 | Cr: 0.83, Ca: 0.0014 | 755 | 916 | 836 |

(Underline: out of range of invention of present application, —: less than detection limit)

TABLE 3

| | Hot rolling condition | Cold rolling condition | Annealing condition | | | | | | Tempering condition | |
|---|---|---|---|---|---|---|---|---|---|---|
| Manufacturing No. | Coiling temperature (° C.) | Cold rolling ratio (%) | Annealing temperature (° C.) | Annealing holding time (s) | Slow cooling rate (° C./s) | Slow cooling completion temperature (° C.) | Rapid cooling rate (° C./s) | Rapid cooling completion temperature (° C.) | Tempering temperature (° C.) | Tempering holding time (s) |
| 1 | 650 | 70 | 800 | 120 | 10 | 600 | 75 | 60 | 450 | 300 |
| 2 | 700 | 70 | 800 | 120 | 10 | 600 | 75 | 60 | 450 | 300 |
| 3 | 500 | 70 | 800 | 120 | 10 | 600 | 75 | 60 | 400 | 300 |
| 4 | 500 | 60 | 800 | 120 | 10 | 600 | 75 | 60 | 425 | 300 |
| 5 | 500 | 70 | 775 | 120 | 10 | 600 | 75 | 60 | 450 | 300 |
| 6 | 625 | 70 | 800 | 120 | 10 | 600 | 75 | 60 | 450 | 300 |
| 7 | 700 | 70 | 800 | 120 | 10 | 600 | 75 | 60 | 450 | 300 |
| 8 | 700 | 75 | 800 | 120 | 10 | 600 | 75 | 60 | 450 | 300 |
| 9 | 700 | 70 | 775 | 120 | 10 | 600 | 75 | 60 | 450 | 300 |
| 10 | 650 | 70 | 825 | 120 | 10 | 600 | 75 | 60 | 450 | 300 |
| 11 | 650 | 70 | 900 | 120 | 10 | 600 | 75 | 60 | 450 | 300 |
| 12 | 800 | 70 | 800 | 120 | 10 | 600 | 75 | 60 | 450 | 300 |
| 13 | 650 | 50 | 800 | 120 | 10 | 600 | 75 | 60 | 450 | 300 |
| 14 | 650 | 70 | 800 | 90 | 10 | 600 | 75 | 60 | 450 | 300 |
| 15 | 650 | 70 | 800 | 900 | 10 | 600 | 75 | 60 | 450 | 300 |
| 16 | 650 | 70 | 800 | 120 | 0.5 | 600 | 75 | 60 | 450 | 300 |
| 17 | 650 | 70 | 800 | 120 | 5 | 600 | 75 | 60 | 450 | 300 |
| 18 | 650 | 70 | 800 | 120 | 20 | 600 | 75 | 60 | 450 | 300 |
| 19 | 650 | 70 | 800 | 120 | 10 | 450 | 75 | 60 | 450 | 300 |
| 20 | 650 | 70 | 800 | 120 | 10 | 550 | 75 | 60 | 450 | 300 |
| 21 | 650 | 70 | 800 | 120 | 10 | 750 | 75 | 60 | 450 | 300 |
| 22 | 650 | 70 | 800 | 120 | 10 | 600 | 15 | 60 | 450 | 300 |
| 23 | 650 | 70 | 800 | 120 | 10 | 600 | 150 | 60 | 450 | 300 |
| 24 | 650 | 70 | 800 | 120 | 10 | 600 | 75 | 300 | 450 | 300 |
| 25 | 650 | 70 | 800 | 120 | 10 | 600 | 75 | 10 | 450 | 300 |
| 26 | 650 | 70 | 800 | 120 | 10 | 600 | 75 | 60 | 250 | 300 |
| 27 | 650 | 70 | 800 | 120 | 10 | 600 | 75 | 60 | 350 | 300 |

TABLE 3-continued

| Manufacturing No. | Hot rolling condition: Coiling temperature (° C.) | Cold rolling condition: Cold rolling ratio (%) | Annealing condition: Annealing temperature (° C.) | Annealing condition: Annealing holding time (s) | Annealing condition: Slow cooling rate (° C./s) | Annealing condition: Slow cooling completion temperature (° C.) | Annealing condition: Rapid cooling rate (° C./s) | Annealing condition: Rapid cooling completion temperature (° C.) | Tempering condition: Tempering temperature (° C.) | Tempering condition: Tempering holding time (s) |
|---|---|---|---|---|---|---|---|---|---|---|
| 28 | 650 | 70 | 800 | 120 | 10 | 600 | 75 | 60 | 550 | 300 |
| 29 | 650 | 70 | 800 | 120 | 10 | 600 | 75 | 60 | 450 | 90 |
| 30 | 650 | 70 | 800 | 120 | 10 | 600 | 75 | 60 | 450 | 900 |

(Underline: out of range of invention of present application)

TABLE 4

(Continued from Table 3)

| Manufacturing No. | Hot rolling condition: Coiling temperature (° C.) | Cold rolling condition: Cold rolling ratio (%) | Annealing condition: Annealing temperature (° C.) | Annealing condition: Annealing holding time (s) | Annealing condition: Slow cooling rate (° C./s) | Annealing condition: Slow cooling completion temperature (° C.) | Annealing condition: Rapid cooling rate (° C./s) | Annealing condition: Rapid cooling completion temperature (° C.) | Tempering condition: Tempering temperature (° C.) | Tempering condition: Tempering holding time (s) |
|---|---|---|---|---|---|---|---|---|---|---|
| 31 | 650 | 70 | 800 | 120 | 10 | 600 | 75 | 60 | 450 | 300 |
| 32 | 650 | 70 | 800 | 120 | 10 | 600 | 75 | 60 | 400 | 300 |
| 33 | 650 | 60 | 800 | 120 | 10 | 600 | 75 | 60 | 425 | 300 |
| 34 | 650 | 70 | 800 | 120 | 10 | 600 | 75 | 60 | 450 | 300 |
| 35 | 650 | 70 | 775 | 120 | 10 | 600 | 75 | 60 | 450 | 300 |
| 36 | 650 | 70 | 775 | 120 | 10 | 600 | 75 | 60 | 450 | 300 |
| 37 | 650 | 70 | 800 | 120 | 10 | 600 | 75 | 60 | 450 | 300 |
| 38 | 650 | 70 | 800 | 120 | 10 | 650 | 75 | 60 | 450 | 300 |
| 39 | 650 | 70 | 800 | 120 | 10 | 600 | 75 | 60 | 450 | 300 |
| 40 | 700 | 75 | 800 | 120 | 10 | 600 | 75 | 60 | 450 | 300 |
| 41 | 650 | 70 | 800 | 120 | 10 | 625 | 75 | 60 | 450 | 300 |
| 42 | 650 | 70 | 775 | 120 | 10 | 600 | 75 | 60 | 450 | 300 |
| 43 | 650 | 70 | 825 | 120 | 10 | 600 | 75 | 60 | 400 | 300 |
| 44 | 700 | 65 | 800 | 120 | 10 | 600 | 75 | 35 | 375 | 300 |
| 45 | 650 | 70 | 800 | 120 | 10 | 600 | 75 | 60 | 450 | 300 |
| 46 | 650 | 65 | 800 | 120 | 10 | 600 | 75 | 60 | 475 | 300 |
| 47 | 650 | 70 | 775 | 120 | 10 | 600 | 75 | 60 | 450 | 300 |
| 48 | 650 | 65 | 775 | 240 | 10 | 600 | 75 | 60 | 425 | 450 |
| 49 | 650 | 70 | 825 | 120 | 10 | 600 | 75 | 60 | 450 | 300 |
| 50 | 650 | 65 | 800 | 120 | 20 | 600 | 75 | 30 | 450 | 300 |
| 51 | 650 | 70 | 800 | 120 | 10 | 600 | 75 | 60 | 450 | 300 |
| 52 | 650 | 70 | 775 | 120 | 10 | 600 | 75 | 60 | 450 | 300 |
| 53 | 650 | 70 | 825 | 120 | 10 | 600 | 75 | 60 | 450 | 300 |
| 54 | 750 | 70 | 825 | 120 | 10 | 600 | 75 | 60 | 350 | 300 |
| 55 | 750 | 75 | 825 | 120 | 10 | 625 | 75 | 60 | 375 | 300 |
| 56 | 650 | 70 | 775 | 120 | 10 | 600 | 75 | 60 | 475 | 300 |
| 57 | 700 | 65 | 775 | 150 | 8 | 600 | 75 | 60 | 475 | 300 |
| 58 | 650 | 70 | 800 | 120 | 10 | 600 | 100 | 60 | 375 | 300 |
| 59 | 650 | 70 | 800 | 120 | 10 | 625 | 75 | 60 | 400 | 250 |
| 60 | 700 | 70 | 775 | 120 | 10 | 600 | 75 | 60 | 450 | 300 |

(Underline: out of range of invention of present application)

TABLE 5

(Continued from Table 4)

| Manufacturing No. | Hot rolling condition: Coiling temperature (° C.) | Cold rolling condition: Cold rolling ratio (%) | Annealing condition: Annealing temperature (° C.) | Annealing condition: Annealing holding time (s) | Annealing condition: Slow cooling rate (° C./s) | Annealing condition: Slow cooling completion temperature (° C.) | Annealing condition: Rapid cooling rate (° C./s) | Annealing condition: Rapid cooling completion temperature (° C.) | Tempering condition: Tempering temperature (° C.) | Tempering condition: Tempering holding time (s) |
|---|---|---|---|---|---|---|---|---|---|---|
| 61 | 650 | 65 | 800 | 120 | 10 | 600 | 75 | 60 | 450 | 300 |
| 62 | 650 | 70 | 800 | 180 | 10 | 600 | 75 | 60 | 450 | 300 |
| 63 | 650 | 70 | 800 | 120 | 20 | 600 | 75 | 60 | 450 | 300 |
| 64 | 650 | 70 | 800 | 120 | 10 | 625 | 75 | 60 | 450 | 300 |
| 65 | 650 | 70 | 800 | 120 | 10 | 600 | 120 | 60 | 475 | 300 |
| 66 | 650 | 70 | 800 | 120 | 10 | 600 | 75 | 45 | 400 | 300 |

TABLE 5-continued (Continued from Table 4)

| Manufacturing No. | Hot rolling condition Coiling temperature (° C.) | Cold rolling condition Cold rolling ratio (%) | Annealing condition Annealing temperature (° C.) | Annealing holding time (s) | Slow cooling rate (° C./s) | Slow cooling completion temperature (° C.) | Rapid cooling rate (° C./s) | Rapid cooling completion temperature (° C.) | Tempering condition Tempering temperature (° C.) | Tempering holding time (s) |
|---|---|---|---|---|---|---|---|---|---|---|
| 67 | 650 | 70 | 800 | 120 | 10 | 600 | 75 | 60 | 450 | 300 |
| 68 | 650 | 70 | 800 | 120 | 10 | 600 | 75 | 60 | 375 | 250 |
| 69 | 650 | 70 | 800 | 120 | 10 | 600 | 75 | 60 | 400 | 300 |
| 70 | 650 | 55 | 800 | 120 | 10 | 600 | 75 | 60 | 450 | 300 |
| 71 | 650 | 70 | 775 | 120 | 10 | 600 | 75 | 60 | 425 | 300 |
| 72 | 650 | 70 | 775 | 90 | 10 | 600 | 75 | 60 | 450 | 300 |
| 73 | 650 | 70 | 800 | 120 | 8 | 600 | 75 | 60 | 450 | 300 |
| 74 | 650 | 70 | 800 | 120 | 10 | 575 | 75 | 60 | 475 | 300 |
| 75 | 650 | 70 | 800 | 120 | 10 | 600 | 60 | 60 | 450 | 300 |
| 76 | 650 | 70 | 800 | 120 | 10 | 600 | 75 | 80 | 425 | 300 |
| 77 | 650 | 70 | 800 | 120 | 10 | 600 | 75 | 60 | 475 | 300 |
| 78 | 650 | 70 | 850 | 120 | 10 | 600 | 75 | 60 | 450 | 350 |
| 79 | 650 | 70 | 775 | 120 | 10 | 625 | 75 | 60 | 425 | 300 |
| 80 | 650 | 70 | 825 | 120 | 10 | 575 | 75 | 60 | 450 | 300 |

(Underline: out of range of invention of present application)

With respect to each steel sheet after heat treatment, the area ratio of each phase over the entire steel sheet thickness, the area ratio of ferrite in the steel sheet surface layer section and the center section, and the hardness in the steel sheet surface layer section and the center section were measured by the measuring method described in the section of [Description of Embodiments] described above.

Also, with respect to each steel sheet after the heat treatment described above, the property of each steel was evaluated by measuring the tensile strength TS, elongation EL and stretch flange formability λ.

More specifically, with respect to the property of the steel sheet after the heat treatment, those satisfying all of TS≥980 MPa, EL≥13%, λ≥40% were evaluated to have passed (○), and those other than them were evaluated to have failed (×).

Also, with respect to the stability of the property of the steel sheet after heat treatment, for specimens having the same steel kind, heat treatment was executed changing the manufacturing condition within the maximum fluctuation range of the manufacturing condition of the actual machine, those satisfying all of ΔTS≤200 MPa, ΔEL≤2%, and Δλ≤20% with ΔTS, ΔEL, and Δλ being the variation width of TS, EL, and λ respectively were evaluated to have passed (○), and those other than them were evaluated to have failed (×).

Also, with respect to the tensile strength TS and the elongation EL, No. 5 specimen described in JIS Z 2201 was manufactured so that the longitudinal axis thereof became the direction orthogonal to the rolling direction, and measurement was executed according to JIS Z 2241.

Further, with respect to the stretch flange formability λ, the hole expanding test was executed according to the Japan Iron and Steel Federation Standards JFST 1001 to measure the hole expansion ratio, and the result was made the stretch flange formability.

The measurement results are illustrated in Tables 6-9.

From these Tables, steel Nos. 1A-2A, 6A-9A, 32A-35A, 37A-50A, 54A-60A are the inventive steels satisfying all requirements of the invention of the present application. It is known that, in any of the invention examples, a homogeneous cold-rolled steel sheet not only excellent in the absolute value of the mechanical property but also suppressing the variation in the mechanical property was obtained.

Further, steel Nos. 14A, 15A, 17A, 18A, 20A, 23A, 25A, 27A, 29A, 30A, 61A-80A also satisfy all requirements of the invention of the present application. With respect to these steel sheets, although it has been confirmed to be excellent in the absolute values of the mechanical property, evaluation of the variation in the mechanical property has not been executed yet. However, it is presumed that the variation in the mechanical property is also in the acceptable level similarly to the inventive steels described above.

On the other hand, each of the comparative steels not satisfying any of the requirements of the invention of the present application has such problems as described below.

In steel Nos. 3A-5A, because the coiling temperature is excessively low, bainite is liable to be formed in the microstructure of the hot-rolled sheet obtained after coiling. Further, because the cold rolling ratio is higher than normal, bainite in the surface layer section is liable to be decomposed in annealing heating, and the ferrite fraction is liable to change. As a result, the difference in the ferrite fraction and the hardness relative to those of the inside (center section) increases, and, even though the property is satisfied, the variation in the tensile strength TS increases, and the acceptance criterion is not attained.

In steel Nos. 10A, 11A, because the annealing temperature is excessively high, the ferrite fraction of the surface layer section accompanying decarburization increases, the difference in the ferrite fraction between the surface layer section and the inside increases, even though the property is satisfied, the variation in the elongation EL increases, and the acceptance criterion is not attained.

In steel No. 12A, contrary to steel Nos. 3A-5A, because the coiling temperature is excessively high, ferrite in the surface layer section grows excessively. As a result, the difference in the ferrite fraction and the hardness relative to those of the inside (center section) increases, even though the property is satisfied, the variation in the elongation EL increases, and the acceptance criterion is not attained.

In steel No. 13A, because the cold rolling ratio is excessively low, the difference of the ferrite fraction and the hardness between the surface layer section and the inside increases, even though the property is satisfied, the variation in the elongation EL increases, and the acceptance criterion is not attained.

In steel No. 16A, because the slow cooling rate is excessively low, ferrite grows excessively both in the surface layer section and the inside, the ferrite fraction of the entire microstructure of the steel sheet becomes excessive, and the tensile strength TS cannot be secured.

In steel No. 19A, because the slow cooling completion temperature is excessively low, ferrite is formed excessively, the ferrite fraction becomes excessive, and the tensile strength TS cannot be secured.

On the other hand, in steel No. 21A, because the slow cooling completion temperature is excessively high, ferrite is not formed sufficiently, the ferrite fraction of the entire microstructure of the steel sheet becomes insufficient, and the elongation EL cannot be secured.

In steel No. 22A, because the rapid cooling rate is excessively low, other microstructures (mainly retained austenite) are formed, and the stretch flange formability λ cannot be secured.

In steel No. 24A, because the rapid cooling completion temperature is excessively high, other microstructures (mainly retained austenite) are formed, and the stretch flange formability λ cannot be secured.

In steel No. 26A, because the tempering temperature is excessively low, the hardness of the hard second phase increases, the entire microstructure of the steel sheet becomes excessively hard, the degree of non-uniformity of the strength in the microstructure increases, and the elongation EL and the stretch flange formability λ cannot be secured.

In steel No. 28A, because the tempering temperature is excessively high, the hard second phase of the surface layer section is softened excessively in particular, and the tensile strength TS cannot be secured.

In steel No. 31A, because Si content is excessively high, ferrite is strengthened excessively in solid solution, the ductility is impaired, and the elongation EL and the stretch flange formability λ cannot be secured.

In steel No. 36A, because C content is excessively high, due to suppression of ferritic transformation, increase of the quenchability, and the like, the ferrite fraction becomes insufficient, and the elongation EL and the stretch flange formability λ cannot be secured.

In steel No. 51A, because Mn content is excessively low, solid solution strengthening of ferrite is insufficient, and the tensile strength TS cannot be secured.

On the other hand, in steel No. 52A, because Mn content is excessively high, due to suppression of ferritic transformation, increase of the quenchability, and the like, the ferrite fraction becomes insufficient, and the elongation EL and the stretch flange formability λ cannot be secured.

In steel No. 53A, contrary to steel No. 36A, because C content is excessively low, the ferrite fraction becomes excessive, and the tensile strength TS cannot be secured.

In the meantime, the difference in the microstructure in the surface layer section and the center section of the inventive steel (steel No. 6A) and the comparative steel (steel No. 10A) will be illustrated as an example in FIG. 1. The drawing is the result of the observation using an optical microscope, the whitish region without a pattern is ferrite, and the blackish region is the hard second phase. As it is clear from the drawing, it is noticed that, in the comparative steel, the ferrite fraction of the surface layer section is significantly higher than that of the center section, whereas in the inventive steel, the ferrite fraction of the surface layer section is generally the same degree of that of the center section.

TABLE 6

| | | | Microstructure of surface layer section | | | | Microstructure of center section | | Area ratio of entire microstructure | | |
|---|---|---|---|---|---|---|---|---|---|---|---|
| Steel No. | Steel kind | Manufacturing No. | α-area ratio Vαs (%) | ΔVα = Vαs − Vαc (%) | Hardness Hvs (Hv) | RHv = Hvs/Hvc (Hv) | α-area ratio Vαc (%) | Hardness Hvc (Hv) | α (%) | Hard second phase (%) | Other microstructure (%) |
| 1A | 1 | 1 | 48 | 8 | 269 | 0.77 | 40 | 350 | 40 | 60 | 0 |
| 2A | | 2 | 45 | 7 | 273 | 0.77 | 38 | 355 | 38 | 62 | 0 |
| 3A | 27 | 3 | 52 | 15 | 264 | 0.74 | 37 | 357 | 37 | 63 | 0 |
| 4A | | 4 | 56 | 17 | 258 | 0.73 | 39 | 352 | 39 | 61 | 0 |
| 5A | | 5 | 51 | 14 | 265 | 0.74 | 37 | 357 | 37 | 63 | 0 |
| 6A | 27 | 6 | 43 | 6 | 275 | 0.77 | 37 | 357 | 37 | 63 | 0 |
| 7A | | 7 | 41 | 5 | 278 | 0.77 | 36 | 360 | 36 | 64 | 0 |
| 8A | | 8 | 40 | 4 | 279 | 0.78 | 36 | 360 | 36 | 64 | 0 |
| 9A | | 9 | 43 | 5 | 275 | 0.77 | 38 | 355 | 38 | 62 | 0 |
| 10A | 27 | 10 | 53 | 15 | 262 | 0.74 | 38 | 355 | 38 | 62 | 0 |
| 11A | | 11 | 81 | 22 | 261 | 0.75 | 39 | 350 | 39 | 61 | 0 |
| 12A | | 12 | 63 | 26 | 249 | 0.70 | 37 | 357 | 37 | 63 | 0 |
| 13A | | 13 | 66 | 26 | 245 | 0.70 | 40 | 350 | 40 | 60 | 0 |
| 14A | 27 | 14 | 38 | 2 | 282 | 0.78 | 36 | 360 | 36 | 64 | 0 |
| 15A | 27 | 15 | 45 | 5 | 273 | 0.78 | 40 | 350 | 40 | 60 | 0 |
| 16A | 27 | 16 | 80 | 25 | 227 | 0.73 | 55 | 312 | 55 | 45 | 0 |
| 17A | 27 | 17 | 45 | 3 | 273 | 0.79 | 42 | 345 | 42 | 58 | 0 |
| 18A | 27 | 18 | 40 | 4 | 279 | 0.78 | 36 | 360 | 36 | 64 | 0 |
| 19A | 27 | 19 | 78 | 24 | 229 | 0.73 | 54 | 315 | 54 | 46 | 0 |
| 20A | 27 | 20 | 51 | 6 | 265 | 0.79 | 45 | 337 | 45 | 55 | 0 |

| | Mechanical property | | | | Variation in mechanical property | | | |
|---|---|---|---|---|---|---|---|---|
| Steel No. | TS (MPa) | EL (%) | λ (%) | Evaluation | ΔTS (MPa) | ΔEL (%) | Δλ (%) | Evaluation |
| 1A | 1009 | 14.4 | 46.7 | ○ | 3 | 1.2 | 4.8 | ○ |
| 2A | 1006 | 13.2 | 51.5 | ○ | | | | |
| 3A | 1195 | 13.2 | 45.8 | ○ | 210 | 1.8 | 1.1 | X |
| 4A | 985 | 15.0 | 46.9 | ○ | | | | |
| 5A | 1027 | 15.0 | 46.0 | ○ | | | | |
| 6A | 1074 | 13.7 | 44.6 | ○ | 38 | 1.6 | 7.8 | ○ |
| 7A | 1139 | 13.9 | 51.3 | ○ | | | | |

TABLE 6-continued

| | | | | | | | | |
|---|---|---|---|---|---|---|---|---|
| 8A | 1042 | 13.0 | 52.4 | ○ | | | | |
| 9A | 1077 | 14.6 | 46.2 | ○ | | | | |
| 10A | 995 | 15.5 | 56.9 | ○ | 111 | 2.4 | 16.7 | X |
| 11A | 1059 | 13.7 | 49.6 | ○ | | | | |
| 12A | 1106 | 13.1 | 40.2 | ○ | | | | |
| 13A | 1013 | 14.2 | 47.4 | ○ | | | | |
| 14A | 1117 | 13.6 | 44.9 | ○ | — | — | — | — |
| 15A | 1016 | 14.7 | 45.5 | ○ | — | — | — | — |
| 16A | 911 | 17.0 | 61.4 | X | — | — | — | — |
| 17A | 1047 | 14.8 | 43.1 | ○ | — | — | — | — |
| 18A | 1092 | 13.5 | 47.1 | ○ | — | — | — | — |
| 19A | 968 | 15.7 | 48.0 | X | — | — | — | — |
| 20A | 1001 | 14.0 | 44.9 | ○ | — | — | — | — |

(Underline: out of range of invention of present application, —: not yet evaluated, α: ferrite, other microstructure: retained austenite + martensite)

TABLE 7

(Continued from Table 6)

| | | | Microstructure of surface layer section | | | | Microstructure of center section | | Area ratio of entire microstructure | | |
|---|---|---|---|---|---|---|---|---|---|---|---|
| Steel No. | Steel kind | Manufacturing No. | α-area ratio Vαs (%) | ΔVα = Vαs − Vαc (%) | Hardness Hvs (Hv) | RHv = Hvs/Hvc (Hv) | α-area ratio Vαc (%) | Hardness Hvc (Hv) | α (%) | Hard second phase (%) | Other microstructure (%) |
| 21A | 27 | 21 | 20 | 3 | 306 | 0.81 | 17 | 377 | 17 | 83 | 0 |
| 22A | 27 | 22 | 39 | 2 | 281 | 0.83 | 37 | 340 | 37 | 56 | 7 |
| 23A | 27 | 23 | 41 | 5 | 278 | 0.77 | 36 | 360 | 36 | 64 | 0 |
| 24A | 27 | 24 | 42 | 4 | 277 | 0.85 | 38 | 327 | 38 | 51 | 11 |
| 25A | 27 | 25 | 40 | 4 | 279 | 0.78 | 36 | 360 | 36 | 64 | 0 |
| 26A | 27 | 26 | 40 | 3 | 324 | 0.74 | 37 | 440 | 37 | 63 | 0 |
| 27A | 27 | 27 | 40 | 2 | 336 | 0.88 | 38 | 384 | 38 | 62 | 0 |
| 28A | 27 | 28 | 40 | 3 | 223 | 0.73 | 37 | 306 | 37 | 63 | 0 |
| 29A | 27 | 29 | 41 | 2 | 281 | 0.80 | 39 | 352 | 39 | 61 | 0 |
| 30A | 27 | 30 | 40 | 2 | 279 | 0.79 | 38 | 355 | 38 | 62 | 0 |
| 31A | 3 | 31 | 43 | 4 | 275 | 0.78 | 39 | 352 | 39 | 61 | 0 |
| 32A | 4 | 32 | 44 | 3 | 297 | 0.78 | 41 | 380 | 41 | 59 | 0 |
| 33A | | 33 | 48 | 8 | 279 | 0.76 | 40 | 365 | 40 | 60 | 0 |
| 34A | 5 | 34 | 41 | 6 | 278 | 0.77 | 35 | 362 | 35 | 65 | 0 |
| 35A | | 35 | 41 | 5 | 278 | 0.77 | 36 | 360 | 36 | 64 | 0 |
| 36A | 6 | 36 | 18 | 2 | 308 | 0.81 | 16 | 379 | 16 | 84 | 0 |
| 37A | 7 | 37 | 42 | 3 | 277 | 0.79 | 39 | 352 | 39 | 61 | 0 |
| 38A | | 38 | 44 | 5 | 274 | 0.78 | 39 | 352 | 39 | 61 | 0 |
| 39A | 8 | 39 | 42 | 4 | 277 | 0.78 | 38 | 355 | 38 | 62 | 0 |
| 40A | | 40 | 40 | 4 | 279 | 0.78 | 36 | 360 | 36 | 64 | 0 |

| | Mechanical property | | | | Variation in mechanical property | | | |
|---|---|---|---|---|---|---|---|---|
| Steel No. | TS (MPa) | EL (%) | λ (%) | Evaluation | ΔTS (MPa) | ΔEL (%) | Δλ (%) | Evaluation |
| 21A | 1248 | 12.4 | 55.5 | X | — | — | — | — |
| 22A | 1026 | 16.4 | 21.1 | X | — | — | — | — |
| 23A | 1121 | 15.0 | 48.3 | ○ | — | — | — | — |
| 24A | 999 | 17.2 | 23.7 | X | — | — | — | — |
| 25A | 1121 | 14.4 | 46.8 | ○ | — | — | — | — |
| 26A | 1390 | 12.1 | 32.0 | X | 58 | 2.1 | 14 | X |
| 27A | 1192 | 13.1 | 45.2 | ○ | — | — | — | — |
| 28A | 959 | 16.1 | 50.8 | X | — | — | — | — |
| 29A | 1090 | 14.3 | 48.5 | ○ | — | — | — | — |
| 30A | 1056 | 13.8 | 47.6 | ○ | — | — | — | — |
| 31A | 974 | 16.6 | 40.2 | X | — | — | — | — |
| 32A | 1166 | 13.8 | 43.1 | ○ | 1 | 0.3 | 1.8 | ○ |
| 33A | 1165 | 13.5 | 44.9 | ○ | | | | |
| 34A | 1179 | 13.4 | 44.3 | ○ | 52 | 0.3 | 2.0 | ○ |
| 35A | 1131 | 13.7 | 46.3 | ○ | | | | |
| 36A | 1114 | 12.5 | 36.6 | X | — | — | — | — |
| 37A | 1140 | 13.2 | 46.4 | ○ | 11 | 0.1 | 5.1 | ○ |
| 38A | 1129 | 13.1 | 51.5 | ○ | | | | |
| 39A | 1059 | 13.4 | 43.9 | ○ | 46 | 0.1 | 0.4 | ○ |
| 40A | 1013 | 13.5 | 43.5 | ○ | | | | |

(Underline: out of range of invention of present application, —: not yet evaluated, α: ferrite, other microstructure: retained austenite + martensite)

TABLE 8

(Continued from Table 7)

| Steel No. | Steel kind | Manufacturing No. | Microstructure of surface layer section: α-area ratio Vαs (%) | ΔVα = Vαs − Vαc (%) | Hardness Hvs (Hv) | RHv = Hvs/Hvc (Hv) | Microstructure of center section: α-area ratio Vαc (%) | Hardness Hvc (Hv) | Area ratio of entire microstructure: α (%) | Hard second phase (%) | Other microstructure (%) |
|---|---|---|---|---|---|---|---|---|---|---|---|
| 41A | 9 | 41 | 41 | 4 | 278 | 0.78 | 37 | 357 | 40 | 60 | 0 |
| 42A | | 42 | 41 | 4 | 278 | 0.78 | 37 | 357 | 38 | 62 | 0 |
| 43A | 10 | 43 | 49 | 5 | 289 | 0.78 | 44 | 371 | 37 | 63 | 0 |
| 44A | | 44 | 47 | 4 | 305 | 0.80 | 43 | 383 | 39 | 61 | 0 |
| 45A | 11 | 45 | 42 | 4 | 277 | 0.78 | 38 | 355 | 37 | 63 | 0 |
| 46A | | 46 | 44 | 5 | 264 | 0.78 | 39 | 338 | 37 | 63 | 0 |
| 47A | 12 | 47 | 45 | 3 | 273 | 0.79 | 42 | 345 | 36 | 64 | 0 |
| 48A | | 48 | 44 | 1 | 285 | 0.80 | 43 | 357 | 36 | 64 | 0 |
| 49A | 13 | 49 | 45 | 5 | 273 | 0.78 | 40 | 350 | 38 | 62 | 0 |
| 50A | | 50 | 46 | 4 | 272 | 0.79 | 42 | 345 | 38 | 62 | 0 |
| 51A | 14 | 51 | 55 | 7 | 260 | 0.79 | 48 | 330 | 39 | 61 | 0 |
| 52A | 15 | 52 | 18 | 2 | 308 | 0.82 | 16 | 375 | 37 | 63 | 0 |
| 53A | 16 | 53 | 94 | 2 | 208 | 0.95 | 92 | 220 | 40 | 60 | 0 |
| 54A | 17 | 54 | 49 | 4 | 316 | 0.84 | 45 | 378 | 36 | 64 | 0 |
| 55A | | 55 | 47 | 4 | 305 | 0.80 | 43 | 383 | 40 | 60 | 0 |
| 56A | 18 | 56 | 31 | 6 | 279 | 0.76 | 25 | 369 | 55 | 45 | 0 |
| 57A | | 57 | 30 | 4 | 280 | 0.76 | 26 | 367 | 42 | 58 | 0 |
| 58A | 19 | 58 | 32 | 4 | 335 | 0.87 | 28 | 384 | 36 | 64 | 0 |
| 59A | | 59 | 35 | 6 | 313 | 0.83 | 29 | 377 | 54 | 46 | 0 |
| 60A | 20 | 60 | 30 | 4 | 293 | 0.78 | 26 | 374 | 45 | 55 | 0 |

| Steel No. | Mechanical property: TS (MPa) | EL (%) | λ (%) | Evaluation | Variation in mechanical property: ΔTS (MPa) | ΔEL (%) | Δλ (%) | Evaluation |
|---|---|---|---|---|---|---|---|---|
| 41A | 981 | 15.6 | 52.1 | ○ | 34 | 1.4 | 1.2 | ○ |
| 42A | 1015 | 14.2 | 50.9 | ○ | | | | |
| 43A | 1257 | 13.0 | 44.7 | ○ | 51 | 0.2 | 2.2 | ○ |
| 44A | 1206 | 13.2 | 46.9 | ○ | | | | |
| 45A | 1130 | 13.4 | 48.7 | ○ | 84 | 1.2 | 1.1 | ○ |
| 46A | 1046 | 14.6 | 49.8 | ○ | | | | |
| 47A | 1088 | 13.7 | 50.6 | ○ | 82 | 1.5 | 1.7 | ○ |
| 48A | 1006 | 15.2 | 48.9 | ○ | | | | |
| 49A | 999 | 14.1 | 48.6 | ○ | 14 | 0.2 | 0.1 | ○ |
| 50A | 985 | 14.3 | 48.7 | ○ | | | | |
| 51A | 781 | 18.0 | 45.0 | X | — | — | — | — |
| 52A | 1071 | 11.6 | 35.9 | X | — | — | — | — |
| 53A | 639 | 28.1 | 67.8 | X | — | — | — | — |
| 54A | 1181 | 14.4 | 48.0 | ○ | 61 | 0.3 | 5.0 | ○ |
| 55A | 1120 | 14.7 | 43.0 | ○ | | | | |
| 56A | 1118 | 13.5 | 46.6 | ○ | 15 | 1.0 | 1.0 | ○ |
| 57A | 1103 | 14.5 | 45.6 | ○ | | | | |
| 58A | 1131 | 14.7 | 42.3 | ○ | 26 | 1.3 | 9.8 | ○ |
| 59A | 1157 | 13.4 | 52.1 | ○ | | | | |
| 60A | 1102 | 14.3 | 50.0 | ○ | — | — | — | — |

(Underline: out of range of invention of present application, —: not yet evaluated, α: ferrite, other microstructure: retained austenite + martensite)

TABLE 9

(Continued from Table 8)

| Steel No. | Steel kind | Manufacturing No. | Microstructure of surface layer section: α-area ratio Vαs (%) | ΔVα = Vαs − Vαc (%) | Hardness Hvs (Hv) | RHv = Hvs/Hvc (Hv) | Microstructure of center section: α-area ratio Vαc (%) | Hardness Hvc (Hv) | Area ratio of entire microstructure: α (%) | Hard second phase (%) | Other microstructure (%) |
|---|---|---|---|---|---|---|---|---|---|---|---|
| 61A | 21 | 61 | 32 | 5 | 290 | 0.78 | 27 | 372 | 27 | 73 | 0 |
| 62A | 22 | 62 | 37 | 5 | 283 | 0.79 | 32 | 359 | 32 | 68 | 0 |
| 63A | 23 | 63 | 34 | 4 | 287 | 0.77 | 30 | 374 | 30 | 70 | 0 |
| 64A | 24 | 64 | 35 | 3 | 286 | 0.78 | 32 | 369 | 32 | 68 | 0 |
| 65A | 25 | 65 | 34 | 5 | 276 | 0.77 | 29 | 360 | 29 | 71 | 0 |
| 66A | 26 | 66 | 46 | 4 | 294 | 0.78 | 42 | 377 | 42 | 58 | 0 |

TABLE 9-continued (Continued from Table 8)

| | | | | | | | | | | | |
|---|---|---|---|---|---|---|---|---|---|---|---|
| 67A | 27 | 67 | 33 | 3 | 289 | 0.77 | 30 | 374 | 30 | 70 | 0 |
| 68A | 28 | 68 | 45 | 5 | 309 | 0.81 | 40 | 383 | 40 | 60 | 0 |
| 69A | 29 | 69 | 49 | 8 | 289 | 0.76 | 41 | 380 | 41 | 59 | 0 |
| 70A | 30 | 70 | 45 | 8 | 273 | 0.76 | 37 | 357 | 37 | 63 | 0 |
| 71A | 31 | 71 | 46 | 3 | 282 | 0.79 | 43 | 357 | 43 | 57 | 0 |
| 72A | 32 | 72 | 43 | 3 | 275 | 0.79 | 40 | 350 | 40 | 60 | 0 |
| 73A | 33 | 73 | 43 | 5 | 275 | 0.77 | 38 | 355 | 38 | 62 | 0 |
| 74A | 34 | 74 | 42 | 3 | 267 | 0.79 | 39 | 338 | 39 | 61 | 0 |
| 75A | 35 | 75 | 45 | 5 | 273 | 0.78 | 40 | 350 | 40 | 60 | 0 |
| 76A | 36 | 76 | 46 | 3 | 282 | 0.79 | 43 | 357 | 43 | 57 | 0 |
| 77A | 37 | 77 | 40 | 2 | 269 | 0.79 | 38 | 340 | 38 | 62 | 0 |
| 78A | 38 | 78 | 24 | 2 | 300 | 0.78 | 22 | 384 | 22 | 78 | 0 |
| 79A | 39 | 79 | 45 | 4 | 284 | 0.78 | 41 | 363 | 41 | 59 | 0 |
| 80A | 40 | 80 | 43 | 5 | 275 | 0.77 | 38 | 355 | 38 | 62 | 0 |

| | Mechanical property | | | | Variation in mechanical property | | | |
|---|---|---|---|---|---|---|---|---|
| Steel No. | TS (MPa) | EL (%) | λ (%) | Evaluation | ΔTS (MPa) | ΔEL (%) | Δλ (%) | Evaluation |
| 61A | 1087 | 13.4 | 42.2 | ○ | — | — | — | — |
| 62A | 1019 | 13.4 | 45.5 | ○ | — | — | — | — |
| 63A | 1097 | 13.9 | 47.2 | ○ | — | — | — | — |
| 64A | 1033 | 14.1 | 45.2 | ○ | — | — | — | — |
| 65A | 1087 | 13.1 | 49.1 | ○ | — | — | — | — |
| 66A | 1161 | 13.5 | 44.9 | ○ | — | — | — | — |
| 67A | 1141 | 13.4 | 48.7 | ○ | — | — | — | — |
| 68A | 1137 | 13.1 | 48.5 | ○ | — | — | — | — |
| 69A | 1117 | 13.4 | 47.7 | ○ | — | — | — | — |
| 70A | 1013 | 13.3 | 43.7 | ○ | — | — | — | — |
| 71A | 1113 | 15.6 | 49.4 | ○ | — | — | — | — |
| 72A | 1194 | 14.9 | 44.8 | ○ | — | — | — | — |
| 73A | 1045 | 13.1 | 47.9 | ○ | — | — | — | — |
| 74A | 1073 | 15.9 | 50.3 | ○ | — | — | — | — |
| 75A | 1093 | 13.0 | 43.7 | ○ | — | — | — | — |
| 76A | 1128 | 15.1 | 44.9 | ○ | — | — | — | — |
| 77A | 1087 | 14.3 | 47.1 | ○ | — | — | — | — |
| 78A | 1158 | 13.6 | 45.5 | ○ | — | — | — | — |
| 79A | 1018 | 14.2 | 48.5 | ○ | — | — | — | — |
| 80A | 1031 | 13.5 | 45.0 | ○ | — | — | — | — |

(Underline: out of range of invention of present application, —: not yet evaluated, α: ferrite, other microstructure: retained austenite + martensite)

Example 2

Example in Relation with the Invention of the Present Application that Attained the Object 2 Described Above Steel having various composition was smelted as illustrated in Table 10 and Table 11 below, and an ingot with 120 mm thickness was manufactured. The ingot was hot-rolled to 25 mm thickness, was thereafter hot-rolled again to 3.2 mm thickness under various manufacturing conditions illustrated in Table 12 and Table 13 below, was pickled, was thereafter cold-rolled further to 1.6 mm thickness, and was thereafter subjected to a heat treatment.

Also, the values of Ac1 and Ac3 in Table 10 were obtained using the formulae similar to those in the example 1 described above.

TABLE 10

| Steel | Chemical composition (mass %) [Remainder: Fe and inevitable impurities] | | | | | | | | Ac1 | Ac3 | (Ac1 + Ac3)/2 |
|---|---|---|---|---|---|---|---|---|---|---|---|
| kind | C | Si | Mn | P | S | Al | N | Others | (° C.) | (° C.) | (° C.) |
| 101 | 0.18 | 1.43 | 1.48 | 0.035 | 0.002 | 0.039 | 0.0084 | Ca: 0.0008 | 749 | 888 | 818 |
| 102 | 0.13 | 1.29 | 1.84 | 0.002 | 0.004 | 0.079 | 0.0042 | Ca: 0.0011 | 741 | 894 | 818 |
| 103 | 0.17 | 1.38 | 2.08 | 0.003 | 0.002 | 0.040 | 0.0049 | — | 741 | 888 | 814 |
| 104 | 0.18 | 1.37 | 1.86 | 0.002 | 0.001 | 0.036 | 0.0049 | Kg: 0.0015 | 743 | 885 | 814 |
| 105 | 0.17 | 1.30 | 2.07 | 0.003 | 0.002 | 0.035 | 0.0032 | Ni :0.08 | 737 | 883 | 810 |
| 106 | 0.15 | 1.22 | 1.60 | 0.003 | 0.008 | 0.035 | 0.0045 | Mo: 0.74, Ca: 0.0004 | 741 | 909 | 825 |
| 107 | 0.16 | 1.20 | 1.88 | 0.005 | 0.018 | 0.032 | 0.0043 | Cu: 0.09, Ca: 0.0009 | 738 | 882 | 810 |
| 108 | 0.10 | 0.78 | 1.37 | 0.002 | 0.001 | 0.039 | 0.0045 | — | 731 | 881 | 806 |
| 109 | 0.15 | 1.33 | 1.57 | 0.002 | 0.006 | 0.037 | 0.0039 | Ca: 0.0007 | 745 | 891 | 818 |
| 110 | 0.27 | 1.89 | 0.59 | 0.004 | 0.002 | 0.043 | 0.0054 | Cu: 0.52 | 772 | 889 | 830 |
| 111 | 0.19 | 1.33 | 3.91 | 0.008 | 0.006 | 0.038 | 0.0032 | Ca: 0.0007 | 720 | 881 | 800 |

TABLE 10-continued

| Steel | Chemical composition (mass %) [Remainder: Fe and inevitable impurities] | | | | | | | | Ac1 | Ac3 | (Ac1 + Ac3)/2 |
|---|---|---|---|---|---|---|---|---|---|---|---|
| kind | C | Si | Mn | P | S | Al | N | Others | (° C.) | (° C.) | (° C.) |
| 112 | 0.15 | 1.27 | 5.24 | 0.002 | 0.001 | 0.012 | 0.0048 | — | 704 | 888 | 796 |
| 113 | 0.16 | 1.26 | 1.84 | 0.002 | 0.003 | 0.035 | 0.0072 | — | 740 | 885 | 813 |
| 114 | 0.13 | 1.40 | 1.92 | 0.001 | 0.004 | 0.037 | 0.0041 | Ca: 0.0003, Li: 0.0009 | 743 | 899 | 821 |
| 115 | 0.17 | 1.29 | 0.38 | 0.010 | 0.004 | 0.042 | 0.0041 | Mo: 0.55, Ca: 0.0011 | 756 | 901 | 829 |
| 116 | 0.17 | 1.31 | 1.61 | 0.001 | 0.004 | 0.037 | 0.0042 | Ni: 0.36, Ca: 0.0005 | 738 | 879 | 809 |
| 117 | 0.07 | 0.56 | 1.97 | 0.001 | 0.001 | 0.065 | 0.0032 | REM: 0.0006 | 718 | 881 | 800 |
| 118 | 0.12 | 1.20 | 1.72 | 0.018 | 0.015 | 0.047 | 0.0063 | Ca: 0.0008 | 740 | 893 | 816 |
| 119 | 0.34 | 1.37 | 1.81 | 0.001 | 0.001 | 0.047 | 0.0043 | — | 744 | 853 | 798 |
| 120 | 0.16 | 1.23 | 1.17 | 0.002 | 0.005 | 0.044 | 0.0039 | Li: 0.0021 | 746 | 884 | 815 |
| 121 | 0.24 | 2.52 | 1.80 | 0.006 | 0.005 | 0.046 | 0.0008 | Cr: 0.26, Ca: 0.0012 | 781 | 923 | 852 |
| 122 | 0.16 | 1.22 | 1.80 | 0.003 | 0.004 | 0.046 | 0.0049 | Cr: 0.07, Ca: 0.0006 | 740 | 883 | 812 |
| 123 | 0.11 | 0.95 | 1.42 | 0.002 | 0.003 | 0.039 | 0.0047 | Ca: 0.0009, REM: 0.0013 | 735 | 885 | 810 |
| 124 | 0.15 | 1.42 | 1.54 | 0.003 | 0.004 | 0.092 | 0.0044 | Cu: 0.88, Ni: 0.56, Ca: 0.0008 | 738 | 886 | 812 |
| 125 | 0.15 | 1.17 | 2.09 | 0.001 | 0.005 | 0.031 | 0.0048 | — | 735 | 884 | 809 |
| 126 | 0.20 | 1.68 | 2.12 | 0.014 | 0.003 | 0.053 | 0.0046 | — | 749 | 894 | 822 |

(Underline: out of range of invention of present application, —: less than detection limit)

TABLE 11

(Continued from Table 10)

| Steel | Chemical composition (mass %) [Remainder: Fe and inevitable impurities] | | | | | | | | Ac1 | Ac3 | (Ac1 + Ac3)/2 |
|---|---|---|---|---|---|---|---|---|---|---|---|
| kind | C | Si | Mn | P | S | Al | N | Others | (° C.) | (° C.) | (° C.) |
| 127 | 0.14 | 1.31 | 1.52 | 0.001 | 0.004 | 0.034 | 0.0043 | — | 745 | 893 | 819 |
| 128 | 0.17 | 2.07 | 2.14 | 0.023 | 0.005 | 0.033 | 0.0041 | Cr: 0.69, Ca: 0.0014 | 772 | 919 | 845 |
| 129 | 0.18 | 3.19 | 1.42 | 0.002 | 0.002 | 0.044 | 0.0027 | — | 801 | 966 | 884 |
| 130 | 0.23 | 1.19 | 1.87 | 0.002 | 0.002 | 0.025 | 0.0041 | — | 738 | 866 | 802 |
| 131 | 0.13 | 1.27 | 2.55 | 0.007 | 0.010 | 0.041 | 0.0015 | Li: 0.0005 | 733 | 894 | 813 |
| 132 | 0.14 | 1.16 | 1.57 | 0.003 | 0.001 | 0.039 | 0.0030 | — | 740 | 886 | 813 |
| 133 | 0.18 | 1.28 | 1.50 | 0.001 | 0.004 | 0.036 | 0.0029 | Mo: 0.05, Ca: 0.0015 | 744 | 883 | 813 |
| 134 | 0.02 | 1.26 | 2.13 | 0.003 | 0.002 | 0.044 | 0.0028 | — | 737 | 938 | 837 |
| 135 | 0.17 | 1.19 | 1.61 | 0.003 | 0.005 | 0.046 | 0.0033 | Ca: 0.0003, Mg: 0.0004 | 740 | 879 | 810 |
| 136 | 0.12 | 0.16 | 0.85 | 0.003 | 0.012 | 0.043 | 0.0054 | Ca: 0.0006, Mg: 0.0009 | 719 | 847 | 783 |
| 137 | 0.13 | 1.32 | 3.45 | 0.003 | 0.004 | 0.037 | 0.0052 | — | 724 | 896 | 810 |
| 138 | 0.14 | 1.23 | 1.83 | 0.003 | 0.001 | 0.043 | 0.0089 | Mo: 0.18 | 739 | 895 | 817 |
| 139 | 0.12 | 1.26 | 0.08 | 0.001 | 0.002 | 0.032 | 0.0037 | — | 759 | 896 | 827 |
| 140 | 0.13 | 1.35 | 1.60 | 0.002 | 0.001 | 0.032 | 0.0036 | — | 745 | 897 | 821 |

(Underline: out of range of invention of present application, —: less than detection limit)

TABLE 12

| | Hot rolling | | Annealing condition | | | | | Tempering condition | | |
|---|---|---|---|---|---|---|---|---|---|---|
| Manu-facturing No. | condition Coiling temperature (° C.) | Cold rolling condition Cold rolling ratio (%) | Annealing temperature (° C.) | Annealing holding time (s) | Slow cooling rate (° C./s) | Slow cooling completion temperature (° C.) | Rapid cooling rate (° C./s) | Rapid cooling completion temperature (° C.) | Tempering temperature (° C.) | Tempering holding time (s) |
| 101 | 650 | 50 | 850 | 120 | 10 | 650 | 75 | 60 | 450 | 300 |
| 102 | 650 | 50 | 850 | 120 | 10 | 650 | 75 | 60 | 400 | 300 |
| 103 | 500 | 50 | 850 | 120 | 10 | 600 | 75 | 60 | 450 | 300 |
| 104 | 600 | 50 | 850 | 120 | 10 | 600 | 75 | 60 | 450 | 300 |
| 105 | 700 | 50 | 850 | 120 | 10 | 600 | 75 | 60 | 450 | 300 |
| 106 | 800 | 50 | 850 | 120 | 10 | 600 | 75 | 60 | 450 | 300 |
| 107 | 650 | 70 | 850 | 120 | 10 | 600 | 75 | 60 | 450 | 300 |

TABLE 12-continued

| Manu-facturing No. | Hot rolling condition Coiling temperature (° C.) | Cold rolling condition Cold rolling ratio (%) | Annealing condition: Annealing temperature (° C.) | Annealing holding time (s) | Slow cooling rate (° C./s) | Slow cooling completion temperature (° C.) | Rapid cooling rate (° C./s) | Tempering condition: Rapid cooling completion temperature (° C.) | Tempering temperature (° C.) | Tempering holding time (s) |
|---|---|---|---|---|---|---|---|---|---|---|
| 108 | 650 | 50 | 775 | 120 | 10 | 600 | 75 | 60 | 450 | 300 |
| 109 | 650 | 50 | 825 | 120 | 10 | 600 | 75 | 60 | 450 | 300 |
| 110 | 650 | 50 | 875 | 120 | 10 | 600 | 75 | 60 | 450 | 300 |
| 111 | 650 | 50 | 925 | 120 | 10 | 600 | 75 | 60 | 450 | 300 |
| 112 | 650 | 50 | 850 | 90 | 10 | 600 | 75 | 60 | 450 | 300 |
| 113 | 650 | 50 | 850 | 900 | 10 | 600 | 75 | 60 | 450 | 300 |
| 114 | 650 | 50 | 850 | 120 | 0.5 | 600 | 75 | 60 | 450 | 300 |
| 115 | 650 | 50 | 850 | 120 | 5 | 600 | 75 | 60 | 450 | 300 |
| 116 | 650 | 50 | 850 | 120 | 20 | 600 | 75 | 60 | 450 | 300 |
| 117 | 650 | 50 | 850 | 120 | 10 | 450 | 75 | 60 | 450 | 300 |
| 118 | 650 | 50 | 850 | 120 | 10 | 550 | 75 | 60 | 450 | 300 |
| 119 | 650 | 50 | 850 | 120 | 10 | 750 | 75 | 60 | 450 | 300 |
| 120 | 650 | 50 | 850 | 120 | 10 | 600 | 15 | 60 | 450 | 300 |
| 121 | 650 | 50 | 850 | 120 | 10 | 600 | 150 | 60 | 450 | 300 |
| 122 | 650 | 50 | 850 | 120 | 10 | 600 | 75 | 300 | 450 | 300 |
| 123 | 650 | 50 | 850 | 120 | 10 | 600 | 75 | 10 | 300 | 300 |
| 124 | 650 | 50 | 850 | 120 | 10 | 600 | 75 | 60 | 350 | 300 |
| 125 | 650 | 50 | 850 | 120 | 10 | 600 | 75 | 60 | 50 | 300 |
| 126 | 650 | 50 | 850 | 120 | 10 | 600 | 75 | 60 | 450 | 90 |
| 127 | 650 | 50 | 850 | 120 | 10 | 600 | 75 | 60 | 450 | 900 |
| 128 | 650 | 50 | 840 | 120 | 10 | 600 | 75 | 60 | 450 | 300 |
| 129 | 650 | 45 | 860 | 120 | 10 | 625 | 105 | 60 | 450 | 200 |
| 130 | 625 | 50 | 870 | 120 | 8 | 650 | 75 | 60 | 425 | 300 |
| 131 | 650 | 40 | 850 | 120 | 12 | 600 | 90 | 60 | 475 | 300 |
| 132 | 650 | 50 | 840 | 120 | 10 | 650 | 75 | 30 | 375 | 450 |

(Underline: out of range of invention of present application)

TABLE 13

(Continued from Table 12)

| Manu-facturing No. | Hot rolling condition Coiling temperature (° C.) | Cold rolling condition Cold rolling ratio (%) | Annealing condition: Annealing temperature (° C.) | Annealing holding time (s) | Slow cooling rate (° C./s) | Slow cooling completion temperature (° C.) | Rapid cooling rate (° C./s) | Rapid cooling completion temperature (° C.) | Tempering condition: Tempering temperature (° C.) | Tempering holding time (s) |
|---|---|---|---|---|---|---|---|---|---|---|
| 133 | 675 | 50 | 830 | 120 | 10 | 625 | 90 | 60 | 400 | 300 |
| 134 | 650 | 50 | 850 | 150 | 12 | 600 | 75 | 100 | 450 | 300 |
| 135 | 650 | 50 | 840 | 120 | 12 | 650 | 90 | 60 | 475 | 300 |
| 136 | 650 | 50 | 850 | 120 | 10 | 675 | 75 | 60 | 450 | 200 |
| 137 | 625 | 50 | 850 | 120 | 15 | 650 | 75 | 60 | 475 | 300 |
| 138 | 650 | 50 | 860 | 120 | 10 | 625 | 75 | 60 | 400 | 300 |
| 139 | 675 | 40 | 860 | 120 | 8 | 625 | 90 | 60 | 425 | 300 |
| 140 | 650 | 45 | 850 | 150 | 10 | 650 | 105 | 60 | 450 | 300 |
| 141 | 675 | 50 | 850 | 120 | 12 | 650 | 75 | 60 | 350 | 450 |
| 142 | 650 | 50 | 840 | 120 | 15 | 650 | 90 | 60 | 375 | 300 |
| 143 | 650 | 50 | 825 | 120 | 10 | 625 | 75 | 60 | 450 | 300 |
| 144 | 675 | 50 | 850 | 120 | 10 | 650 | 60 | 60 | 450 | 300 |
| 145 | 625 | 50 | 870 | 120 | 15 | 675 | 75 | 60 | 500 | 200 |
| 146 | 650 | 50 | 850 | 120 | 10 | 675 | 90 | 60 | 425 | 300 |
| 147 | 650 | 50 | 860 | 150 | 12 | 650 | 75 | 60 | 375 | 450 |
| 148 | 675 | 50 | 850 | 120 | 10 | 625 | 75 | 60 | 450 | 300 |
| 149 | 650 | 45 | 850 | 120 | 10 | 625 | 75 | 80 | 400 | 300 |
| 150 | 625 | 50 | 860 | 120 | 10 | 650 | 90 | 60 | 425 | 200 |
| 151 | 650 | 50 | 860 | 120 | 8 | 625 | 75 | 60 | 400 | 300 |
| 152 | 650 | 50 | 870 | 120 | 12 | 675 | 75 | 60 | 425 | 300 |
| 153 | 650 | 50 | 900 | 120 | 15 | 650 | 60 | 60 | 450 | 300 |
| 154 | 650 | 50 | 840 | 120 | 12 | 625 | 90 | 60 | 475 | 450 |
| 155 | 625 | 50 | 830 | 120 | 10 | 600 | 75 | 60 | 400 | 300 |
| 156 | 650 | 50 | 850 | 150 | 12 | 650 | 75 | 60 | 425 | 450 |
| 157 | 650 | 50 | 850 | 120 | 8 | 650 | 60 | 80 | 425 | 200 |
| 158 | 650 | 50 | 870 | 120 | 10 | 650 | 105 | 60 | 450 | 300 |
| 159 | 650 | 50 | 840 | 120 | 10 | 600 | 105 | 60 | 450 | 300 |
| 160 | 675 | 50 | 825 | 120 | 10 | 650 | 90 | 60 | 400 | 300 |
| 161 | 625 | 45 | 850 | 120 | 10 | 650 | 75 | 60 | 425 | 300 |
| 162 | 650 | 45 | 860 | 150 | 10 | 600 | 60 | 80 | 400 | 300 |

TABLE 13-continued (Continued from Table 12)

| Manufacturing No. | Hot rolling condition Coiling temperature (° C.) | Cold rolling condition Cold rolling ratio (%) | Annealing condition Annealing temperature (° C.) | Annealing holding time (s) | Slow cooling rate (° C./s) | Slow cooling completion temperature (° C.) | Rapid cooling rate (° C./s) | Rapid cooling completion temperature (° C.) | Tempering condition Tempering temperature (° C.) | Tempering holding time (s) |
|---|---|---|---|---|---|---|---|---|---|---|
| 163 | 650 | 50 | 850 | 120 | 12 | 650 | 75 | 60 | 425 | 300 |
| 164 | 650 | 50 | 850 | 120 | 10 | 650 | 75 | 60 | 400 | 300 |

(Underline: out of range of invention of present application)

With respect to each steel sheet after heat treatment, the area ratio of each phase over the entire steel sheet thickness, the area ratio of ferrite in the steel sheet surface layer section and the center section, and the average grain size of ferrite in the steel sheet surface layer section were measured by the measuring method described in the section of [Description of Embodiments] described above.

Also, with respect to each steel sheet after the heat treatment described above, the property of each steel was evaluated by measuring the tensile strength TS, elongation EL, stretch flange formability λ, and critical bending radius R.

More specifically, with respect to the property of the steel sheet after the heat treatment, those satisfying all of 780 MPa≤TS<980 MPa, EL≥13%, λ≥40%, R≤1.5 mm and those satisfying all of TS≥1,180 MPa, EL≥10%, λ≥30%, R≤2.5 mm were evaluated to have passed (○), those satisfying all of 980 MPa≤TS<1,180 MPa, EL≥15%, λ>50%, R≤1.0 mm and those satisfying all of TS≥1,180 MPa, EL≥12%, λ≥40%, R≤2.0 mm were evaluated to be significantly excellent (◎), and those other than them were evaluated to have failed (×).

Also, with respect to the tensile strength TS and the elongation EL, No. 5 specimen described in JIS Z 2201 was manufactured so that the longitudinal axis thereof became the direction orthogonal to the rolling direction, and measurement was executed according to JIS Z 2241.

Further, with respect to the stretch flange formability λ, the hole expanding test was executed according to the Japan Iron and Steel Federation Standards JFST 1001 to measure the hole expansion ratio, and the result was made the stretch flange formability.

Also, with respect to the critical bending radius R, No. 1 specimen described in JIS Z 2204 was manufactured so that the direction orthogonal to the rolling direction became the longitudinal direction (the bending ridge line agrees with the rolling direction), the V-bending test was executed according to JIS Z 2248. The bending test was executed making the angle between the die and punch 60° and changing the tip radius in units of 0.5 mm, and the punch tip radius that could bend without causing a crack was obtained as the critical bending radius R.

The measurement results are illustrated in Table 14 and Table 15. From these Tables, steel Nos. 1B, 2B, 4B, 5B, 9B, 10B, 12B, 13B, 15B, 16B, 18B, 21B, 23B-35B, 37B-42B, 44B-52B, 54B-57B, 59B-62B, 64B are the inventive steels satisfying all requirements of the present invention. It is known that, in any of the inventive steels, a cold-rolled steel sheet not only excellent in the tensile strength, elongation and stretch flange formability but also excellent in the bendability was obtained.

On the other hand, each of the comparative steels not satisfying any of the requirements of the invention of the present application has such problems as described below.

In steel No. 3B, because the coiling temperature is excessively low, the ferrite fraction in the surface layer section cannot be increased, and the bendability R does not attain the acceptance criterion.

On the other hand, in steel No. 6B, because the coiling temperature is excessively high, the ferrite grain in the surface layer section is coarsened, and the bendability R does not attain the acceptance criterion also.

In steel No. 7B, because the cold rolling ratio is excessively high, much amount of strain is introduced to the inside (center section), no difference in the ferrite fraction is obtained between the surface layer section and the inside, and the bendability R does not attain the acceptance criterion.

In steel No. 8B, because the annealing temperature is excessively low, no difference in the ferrite fraction is obtained between the surface layer section and the inside, the ferrite grain is coarsened, and the bendability R does not attain the acceptance criterion.

On the other hand, in steel No. 11B, because the annealing temperature is excessively high, excessive increase of the ferrite fraction in the surface layer section accompanying decarburization and coarsening of the ferrite grain occur, and the bendability R does not attain the acceptance criterion also.

In steel No. 14B, because the slow cooling rate is excessively low, ferrite grows excessively both in the surface layer section and the inside, not only the bendability R does not attain the acceptance criterion, but also the tensile strength TS cannot be secured.

In steel No. 17B, because the slow cooling completion temperature is excessively low, ferrite is formed excessively, the ferrite fraction becomes excessive, not only the bendability R does not attain the acceptance criterion, but also the tensile strength TS cannot be secured.

On the other hand, in steel No. 19B, because the slow cooling completion temperature is excessively high, ferrite is not formed sufficiently, the ferrite fraction becomes insufficient, not only the bendability R does not attain the acceptance criterion, but also the elongation EL cannot be secured.

In steel No. 20B, because the rapid cooling rate is excessively low, other microstructures (mainly retained austenite) are formed, and the stretch flange formability λ cannot be secured.

In steel No. 20B, because the rapid cooling temperature is excessively high, other microstructures (mainly retained austenite) are formed, and the stretch flange formability λ cannot be secured.

In steel No. 36B, because Mn content is excessively high, due to suppression of ferritic transformation, increase of the quenchability, and the like, the ferrite fraction becomes insufficient, not only the bendability R does not attain the acceptance criterion, but also the elongation EL and the stretch flange formability λ cannot be secured.

In steel No. 43B, because C content is excessively high, similarly to steel No. 36, due to suppression of ferritic transformation, increase of the quenchability, and the like, the ferrite fraction becomes insufficient, not only the bendability R does not attain the acceptance criterion, but also the elongation EL and the stretch flange formability λ cannot be secured.

In steel No. 53B, because Si content is excessively high, ferrite is strengthened excessively in solid solution, the ductility is impaired, not only the bendability R does not attain the acceptance criterion, but also the elongation EL and the stretch flange formability λ cannot be secured.

In steel No. 58B, contrary to steel No. 43B, because C content is excessively low, the ferrite fraction becomes excessive, and the tensile strength TS cannot be secured.

In steel No. 63B, because Mn content is excessively low, solid solution strengthening of ferrite is insufficient, and the tensile strength TS cannot be secured.

Figure 2:
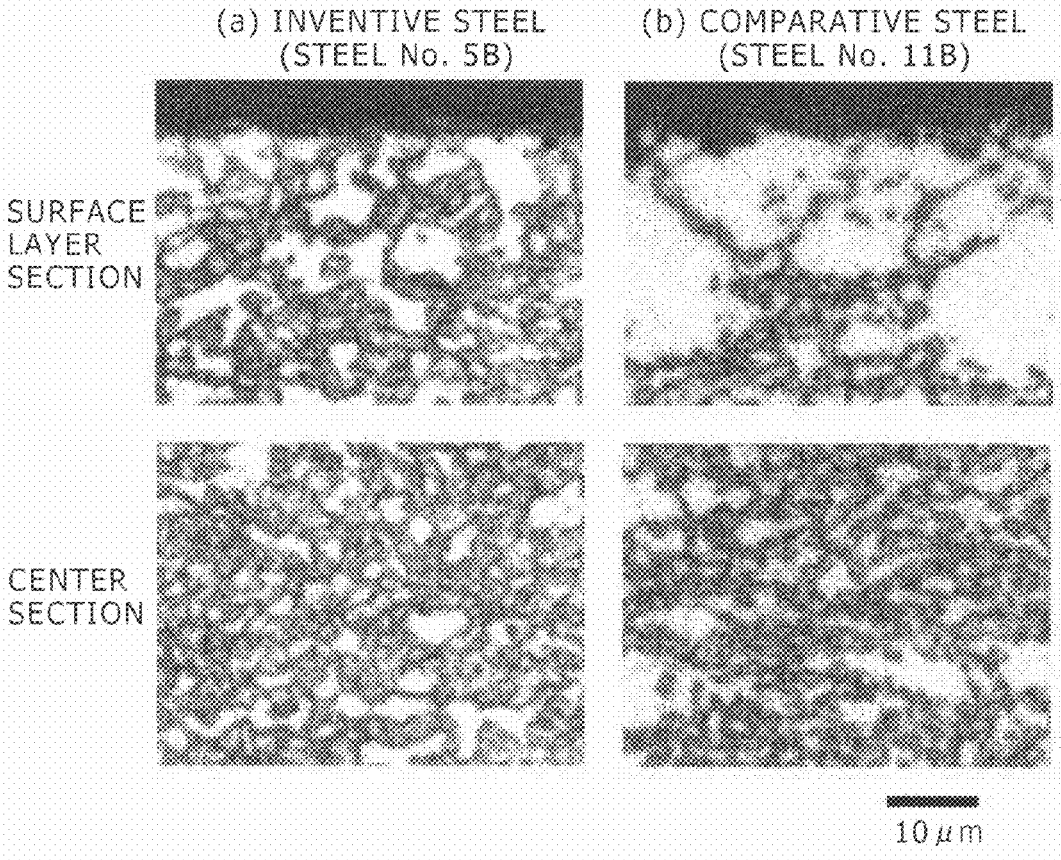
FIG. 2 shows photos of a cross-sectional microstructure of an inventive steel sheet and a comparative steel sheet in relation with the example 2.

In the meantime, the distribution state of the ferrite grains in the surface layer section and the center section of the inventive steel (steel No. 5B) and the comparative steel (steel No. 11B) will be illustrated as an example in FIG. 2. The drawing is the result of the observation using an optical microscope, the whitish region without a pattern is the ferrite grain, and the blackish region is the hard second phase. As it is clear from the drawing, it is noticed that, in the comparative steel, in the surface layer section thereof, coarsened ferrite grains are present and the ferrite fraction becomes significantly higher than that of the center section, whereas in the inventive steel, in the surface layer section thereof, fine ferrite grains are present and the ferrite fraction is in the level of slightly higher than that of the center section.

TABLE 14

| | | | Microstructure of surface layer section | | | Microstructure of center section | Area ratio of entire microstructure | | | | | | | |
|---|---|---|---|---|---|---|---|---|---|---|---|---|---|---|
| | | | α-area ratio | Average grain | ΔVα = | α-area ratio | | Hard second | Other micro- | Mechanical property | | | | |
| Steel No. | Steel kind | Manufacturing No. | Vαs (%) | size of α (μm) | Vαs − Vαc (%) | Vαc (%) | α (%) | phase (%) | structure (%) | TS (MPa) | EL (%) | λ (%) | R (mm) | Evaluation |
| 1B | 191 | 101 | 60 | 7 | 21 | 39 | 40 | 60 | 0 | 1097 | 15.0 | 58.6 | 0.5 | ◎ |
| 2B | 102 | 102 | 66 | 6 | 22 | 44 | 45 | 55 | 0 | 1055 | 14.5 | 61.2 | 0.0 | ○ |
| 3B | 103 | 103 | 48 | 6 | 8 | 40 | 40 | 60 | 0 | 1078 | 15.2 | 55.4 | 2.0 | X |
| 4B | 103 | 104 | 53 | 6 | 12 | 41 | 41 | 59 | 0 | 1062 | 15.1 | 52.1 | 1.0 | ◎ |
| 5B | 103 | 105 | 65 | 9 | 25 | 40 | 41 | 59 | 0 | 1065 | 14.8 | 54.6 | 1.0 | ○ |
| 6B | 103 | 106 | 73 | 12 | 31 | 42 | 43 | 57 | 0 | 1071 | 15.6 | 49.5 | 2.5 | X |
| 7B | 103 | 107 | 40 | 5 | 4 | 36 | 36 | 64 | 0 | 1105 | 14.2 | 56.7 | 2.0 | X |
| 8B | 103 | 108 | 47 | 15 | 6 | 41 | 41 | 59 | 0 | 1056 | 15.8 | 43.2 | 3.0 | X |
| 9B | 103 | 109 | 58 | 8 | 18 | 40 | 41 | 59 | 0 | 1062 | 15.2 | 54.8 | 1.0 | ◎ |
| 10B | 103 | 110 | 77 | 7 | 36 | 41 | 43 | 57 | 0 | 1078 | 15.0 | 62.4 | 0.5 | ◎ |
| 11B | 103 | 111 | 93 | 14 | 55 | 38 | 41 | 59 | 0 | 1098 | 12.8 | 45.7 | 2.5 | X |
| 12B | 103 | 112 | 65 | 7 | 25 | 40 | 41 | 59 | 0 | 1087 | 14.8 | 58.1 | 1.5 | ○ |
| 13B | 103 | 113 | 76 | 6 | 35 | 41 | 43 | 57 | 0 | 1012 | 15.9 | 52.4 | 1.0 | ◎ |
| 14B | 103 | 114 | 97 | 15 | 45 | 52 | 54 | 46 | 0 | 932 | 17.7 | 72.5 | 0.0 | X |
| 15B | 103 | 115 | 79 | 9 | 36 | 43 | 45 | 55 | 0 | 1023 | 15.8 | 54.4 | 0.5 | ◎ |
| 16B | 103 | 116 | 63 | 6 | 25 | 38 | 39 | 61 | 0 | 1070 | 14.9 | 64.5 | 1.5 | ○ |
| 17B | 103 | 117 | 82 | 9 | 31 | 51 | 52 | 48 | 0 | 945 | 16.3 | 72.5 | 0.5 | X |
| 18B | 103 | 118 | 74 | 7 | 30 | 44 | 45 | 55 | 0 | 999 | 16.0 | 65.5 | 0.5 | ◎ |
| 19B | 103 | 119 | 43 | 8 | 25 | 18 | 19 | 81 | 0 | 1151 | 9.3 | 75.4 | 3.5 | X |
| 20B | 103 | 120 | 67 | 8 | 29 | 38 | 39 | 55 | 6 | 1059 | 18.2 | 21.1 | 1.0 | X |
| 21B | 103 | 121 | 70 | 7 | 31 | 39 | 40 | 60 | 0 | 1060 | 15.1 | 52.8 | 1.0 | ◎ |
| 22B | 103 | 122 | 60 | 8 | 20 | 40 | 41 | 49 | 10 | 1085 | 18.5 | 16.9 | 1.0 | X |
| 23B | 103 | 123 | 60 | 7 | 21 | 39 | 40 | 60 | 0 | 1258 | 10.4 | 30.7 | 2.0 | ○ |
| 24B | 103 | 124 | 65 | 7 | 25 | 40 | 41 | 59 | 0 | 1141 | 13.1 | 43.4 | 1.5 | ○ |
| 25B | 103 | 125 | 57 | 7 | 18 | 39 | 40 | 60 | 0 | 974 | 16.9 | 68.7 | 0.5 | ○ |
| 26B | 103 | 126 | 63 | 6 | 22 | 41 | 42 | 58 | 0 | 1088 | 14.3 | 49.9 | 1.5 | ○ |
| 27B | 103 | 127 | 68 | 7 | 28 | 40 | 41 | 59 | 0 | 1032 | 15.7 | 58.6 | 1.0 | ◎ |
| 28B | 104 | 128 | 63 | 8 | 25 | 38 | 39 | 61 | 0 | 1075 | 15.0 | 59.8 | 1.0 | ◎ |
| 29B | 105 | 129 | 51 | 7 | 15 | 36 | 36 | 64 | 0 | 1064 | 15.1 | 60.8 | 1.0 | ◎ |
| 30B | 106 | 130 | 59 | 5 | 23 | 36 | 37 | 63 | 0 | 1050 | 14.9 | 59.3 | 0.0 | ○ |
| 31B | 107 | 131 | 71 | 7 | 29 | 42 | 43 | 57 | 0 | 1069 | 14.8 | 63.2 | 0.0 | ○ |
| 32B | 108 | 132 | 74 | 8 | 26 | 48 | 49 | 51 | 0 | 1023 | 16.7 | 51.8 | 0.5 | ◎ |

(Underline: out of range of invention of present application, α: ferrite, other microstructure: retained austenite + martensite)

TABLE 15

(Continued from Table 14)

| Steel No. | Steel kind | Manufacturing No. | Microstructure of surface layer section: α-area ratio Vαs (%) | Average grain size of α (μm) | ΔVα = Vαs − Vαc (%) | Microstructure of center section: α-area ratio Vαc (%) | Area ratio of entire microstructure: α (%) | Hard second phase (%) | Other microstructure (%) | Mechanical property: TS (MPa) | EL (%) | λ (%) | R (mm) | Evaluation |
|---|---|---|---|---|---|---|---|---|---|---|---|---|---|---|
| 33B | 109 | 133 | 65 | 1 | 22 | 43 | 44 | 56 | 0 | 1051 | 15.0 | 56.6 | 1.0 | ◎ |
| 34B | 110 | 134 | 51 | 5 | 21 | 30 | 31 | 69 | 0 | 1195 | 13.6 | 42.7 | 0.0 | ◎ |
| 35B | 111 | 135 | 56 | 6 | 16 | 40 | 41 | 59 | 0 | 1087 | 15.0 | 61.9 | 0.5 | ◎ |
| 36B | 112 | 136 | 29 | 7 | 12 | 17 | 17 | 83 | 0 | 1325 | 8.1 | 22.1 | 3.5 | X |
| 37B | 113 | 137 | 65 | 6 | 24 | 41 | 42 | 58 | 0 | 1058 | 15.7 | 60.8 | 0.5 | ◎ |
| 38B | 114 | 138 | 66 | 8 | 21 | 45 | 46 | 54 | 0 | 1045 | 15.8 | 58.7 | 0.0 | ◎ |
| 39B | 115 | 139 | 83 | 4 | 35 | 48 | 49 | 51 | 0 | 989 | 15.8 | 55.1 | 0.0 | ◎ |
| 40B | 116 | 140 | 65 | 7 | 24 | 41 | 42 | 58 | 0 | 1075 | 15.5 | 65.4 | 0.5 | ◎ |
| 41B | 117 | 141 | 77 | 9 | 30 | 47 | 48 | 52 | 0 | 983 | 18.4 | 58.9 | 0.0 | ◎ |
| 42B | 118 | 142 | 72 | 8 | 28 | 44 | 45 | 55 | 0 | 1062 | 15.7 | 51.4 | 0.5 | ◎ |
| 43B | 119 | 143 | 36 | 5 | 20 | 16 | 17 | 83 | 0 | 1319 | 8.5 | 29.1 | 4.5 | X |
| 44B | 120 | 144 | 67 | 8 | 22 | 45 | 46 | 54 | 0 | 997 | 15.0 | 56.3 | 1.0 | ◎ |
| 45B | 121 | 145 | 37 | 7 | 12 | 25 | 25 | 75 | 0 | 1285 | 13.5 | 41.9 | 1.0 | ◎ |
| 46B | 122 | 146 | 63 | 8 | 25 | 38 | 39 | 61 | 0 | 1058 | 15.0 | 60.2 | 0.5 | ◎ |
| 47B | 123 | 147 | 77 | 8 | 31 | 46 | 47 | 53 | 0 | 1029 | 15.1 | 52.3 | 1.0 | ◎ |
| 48B | 124 | 148 | 66 | 8 | 26 | 40 | 41 | 59 | 0 | 1044 | 15.7 | 56.5 | 1.0 | ◎ |
| 49B | 125 | 149 | 69 | 7 | 30 | 39 | 40 | 60 | 0 | 1106 | 15.0 | 53.8 | 1.0 | ◎ |
| 50B | 126 | 150 | 52 | 8 | 23 | 29 | 30 | 70 | 0 | 1097 | 15.5 | 62.4 | 0.5 | ◎ |
| 51B | 127 | 151 | 64 | 6 | 21 | 43 | 44 | 56 | 0 | 1049 | 15.2 | 63.1 | 0.5 | ◎ |
| 52B | 128 | 152 | 63 | 7 | 23 | 40 | 41 | 59 | 0 | 1201 | 13.4 | 40.7 | 0.0 | ◎ |
| 53B | 129 | 153 | 53 | 6 | 15 | 38 | 38 | 62 | 0 | 1285 | 10.2 | 35.6 | 3.5 | X |
| 54B | 130 | 154 | 47 | 8 | 18 | 29 | 30 | 70 | 0 | 1181 | 14.3 | 49.1 | 1.5 | ◎ |
| 55B | 131 | 155 | 63 | 7 | 20 | 43 | 44 | 56 | 0 | 1129 | 15.2 | 56.1 | 1.0 | ◎ |
| 56B | 132 | 156 | 66 | 6 | 24 | 42 | 43 | 57 | 0 | 1045 | 15.1 | 60.0 | 1.0 | ◎ |
| 57B | 133 | 157 | 59 | 8 | 21 | 38 | 39 | 61 | 0 | 1086 | 16.0 | 53.5 | 0.0 | ◎ |
| 58B | 134 | 158 | 99 | 16 | 5 | 94 | 94 | 6 | 0 | 658 | 28.1 | 89.5 | 0.0 | X |
| 59B | 135 | 159 | 59 | 6 | 20 | 39 | 40 | 60 | 0 | 1078 | 15.5 | 58.7 | 0.5 | ◎ |
| 60B | 136 | 160 | 79 | 7 | 34 | 45 | 47 | 53 | 0 | 995 | 15.4 | 52.5 | 1.0 | ◎ |
| 61B | 137 | 161 | 57 | 8 | 17 | 40 | 41 | 59 | 0 | 1219 | 13.0 | 40.2 | 1.0 | ◎ |
| 62B | 138 | 162 | 66 | 5 | 24 | 42 | 43 | 57 | 0 | 1039 | 15.0 | 59.9 | 0.0 | ◎ |
| 63B | 139 | 163 | 85 | 9 | 39 | 46 | 48 | 52 | 0 | 889 | 18.8 | 72.5 | 0.0 | X |
| 64B | 140 | 164 | 69 | 7 | 26 | 43 | 44 | 56 | 0 | 1039 | 15.2 | 61.4 | 0.5 | ◎ |

(Underline: out of range of invention of present application, α: ferrite, other microstructure: retained austenite + martensite)

Although the present invention has been described in detail referring to specific embodiments, it is obvious for a person with an ordinary skill in the art that various alterations and amendments can be effected without departing from the spirit and range of the present invention.

The present application is based on Japanese Patent Application (No. 2012-124207) applied on May 31, 2012 and Japanese Patent Application (No. 2012-124208) applied on May 31, 2012, and the contents thereof are hereby incorporated by reference.

INDUSTRIAL APPLICABILITY

The present invention is useful as a cold-rolled steel sheet for automobile components.

The invention claimed is:

1. A cold-rolled steel sheet, comprising:

C: 0.05-0.19 mass %;

Si: 3.0 mass % or less, exclusive of 0 mass %;

Mn: 0.1-5.0 mass %;

P: 0.1 mass % or less, exclusive of 0 mass %;

S: 0.02 mass % or less, exclusive of 0 mass %;

Al: 0.01-1.0 mass %; and

N: 0.01 mass% or less, exclusive of 0 mass % respectively;

iron and inevitable impurities, wherein a microstructure comprises ferrite that is a soft first phase by 20-50% in terms of area ratio, and tempered martensite, tempered bainite, or both, that is a hard second phase;

a difference between area ratio Vαs of ferrite of a steel sheet surface layer section from a steel sheet surface to a depth of 100 μm and area ratio Vαc of ferrite of a center section of t/4-3t/4 ΔVα=Vαs−Vαc is less than 10%, where t is a sheet thickness; and a ratio of hardness Hvs of the steel sheet surface layer section and hardness Hvc of the center section RHv=Hvs/Hvc is 0.75-1.0.

2. The steel sheet according to claim 1, further comprising at least one group selected from groups (a)-(c): (a) Cr: 0.01-1.0 mass %, (b) at least one element selected from the group consisting of Mo: 0.01-1.0 mass %, Cu: 0.05-1.0 mass %, and Ni: 0.05-1.0 mass %, and (c) at least one element selected from the group consisting of Ca: 0.0001-0.01 mass %, Mg: 0.0001-0.01 mass %, Li: 0.0001-0.01 mass %, and REM: 0.0001-0.01 mass %.

3. A method of manufacturing the cold-rolled steel sheet according to claim 1, comprising hot rolling, thereafter cold rolling, thereafter annealing, and tempering with respective conditions (A1)-(A4):

(A1) hot rolling condition:

finish rolling temperature: $Ar_3$ point or above coiling temperature: above 600° C. and 750° C. or below;

(A2) cold rolling condition:

cold rolling ratio: more than 50% and 80% or less;

(A3) annealing condition:

holding at an annealing temperature of Ac1 or above and below (Ac1+Ac3)/2for annealing holding time of 3,600 s or less, thereafter slow cooling with a first cooling rate of 1° C/s or more and less than 50° C/s from the annealing temperature to a first cooling completion temperature of 730° C. or below and 500° C. or above, and thereafter rapid cooling with a second cooling rate of 50° C/s or more to a second cooling completion temperature of Ms point or below; and (A4) tempering condition:

tempering temperature: 300-500° C.

tempering holding time: 60-1,200 s within the temperature range of 300° C.-tempering temperature.

4. A cold-rolled steel sheet comprising:

C: 0.05-0.30 mass %;

Si: 3.0 mass % or less, exclusive of 0 mass %;

Mn: 0.1-5.0 mass %;

P: 0.1 mass % or less, exclusive of 0 mass %;

S: 0.02 mass % or less, exclusive of 0 mass %;

Al: 0.01-1.0 mass %; and

N: 0.0052-0.01 mass %;

iron and inevitable impurities, wherein a microstructure comprises ferrite that is a soft first phase by 20-50% in terms of area ratio, and tempered martensite, tempered bainite, or both, that is a hard second phase;

a difference between area ratio $V\alpha s$ of ferrite of a steel sheet surface layer section from a steel sheet surface to a depth of 100μm and area ratio $V\alpha c$ of ferrite of a center section of $t/4-3t/4\ \Delta V\alpha=V\alpha s-V\alpha c$ is less than 10%, where t is a sheet thickness; and a ratio of hardness Hvs of the steel sheet surface layer section and hardness Hvc of the center section RHv=Hvs/Hvc is 0.75-1.0.

5. The cold-rolled steel sheet according to claim 1, wherein $\Delta V\alpha$ is less than 5%.

6. The cold-rolled steel sheet according to claim 1, wherein RHv is 0.80-1.0.

7. The cold-rolled steel sheet according to claim 1, wherein the microstructure comprises the soft first phase by 35-50% in terms of area ratio.

8. A cold-rolled steel sheet having a tensile strength of from 1,009 to 1,131 MPa, comprising:

C: 0.05-0.30 mass %;

Si: 3.0 mass % or less, exclusive of 0 mass %;

Mn: 0.1-5.0 mass %;

P: 0.1 mass % or less, exclusive of 0 mass %,

S: 0.02 mass % or less, exclusive of 0 mass %;

Al: 0.01-1.0 mass %; and

N: 0.01 mass % or less, exclusive of 0 mass% respectively;

iron and inevitable impurities, wherein a microstructure comprises ferrite that is a soft first phase by 20-50% in terms of area ratio, and tempered martensite, tempered bainite, or both, that is a hard second phase;

a difference between area ratio $V\alpha s$ of ferrite of a steel sheet surface layer section from a steel sheet surface to a depth of 100μm and area ratio $V\alpha c$ of ferrite of a center section of $t/4-3t/4\Delta V\alpha=V\alpha s-V\alpha c$ is less than 10%, where t is a sheet thickness; and a ratio of hardness Hvs of the steel sheet surface layer section and hardness Hvc of the center section RHv=Hvs/Hvc is 0.75-1.0.

9. The steel sheet according to claim 4, further comprising at least one group selected from groups (a)-(c): (a) Cr: 0.01-1.0 mass %, (b) at least one element selected from the group consisting of Mo: 0.01-1.0 mass %, Cu: 0.05-1.0 mass %, and Ni: 0.05-1.0 mass %, and (c) at least one element selected from the group consisting of Ca: 0.0001-0.01 mass %, Mg: 0.0001-0.01 mass %, Li: 0.0001-0.01 mass %, and REM: 0.0001-0.01 mass %.

10. A method of manufacturing the cold-rolled steel sheet according to claim 4, comprising hot rolling, thereafter cold rolling, thereafter annealing, and tempering with respective conditions (A1)-(A4):

(A1) hot rolling condition:

finish rolling temperature: $Ar_3$ point or above coiling temperature: above 600° C. and 750° C. or below;

(A2) cold rolling condition:

cold rolling ratio: more than 50% and 80% or less;

(A3) annealing condition:

holding at an annealing temperature of Ac1 or above and below (Ac1+Ac3)/2 for annealing holding time of 3,600 s or less, thereafter slow cooling with a first cooling rate of 1° C/s or more and less than 50° C/s from the annealing temperature to a first cooling completion temperature of 730° C. or below and 500° C. or above, and thereafter rapid cooling with a second cooling rate of 50° C/s or more to a second cooling completion temperature of Ms point or below; and (A4) tempering condition:

tempering temperature: 300-500° C.

tempering holding time: 60-1,200 s within the temperature range of 300° C. -tempering temperature.

11. The cold-rolled steel sheet according to claim 4, wherein $\Delta V\alpha$ is less than 5%.

12. The cold-rolled steel sheet according to claim 4, wherein RHv is 0.80-1.0.

13. The cold-rolled steel sheet according to claim 4, wherein the microstructure comprises the soft first phase by 35-50% in terms of area ratio.

14. The steel sheet according to claim 8, further comprising at least one group selected from groups (a)-(c): (a) Cr: 0.01-1.0 mass %, (b) at least one element selected from the group consisting of Mo: 0.01-1.0 mass %, Cu: 0.05-1.0 mass %, and Ni: 0.05-1.0 mass %, and (c) at least one element selected from the group consisting of Ca: 0.0001-0.01 mass %, Mg: 0.0001-0.01 mass %, Li: 0.0001-0.01 mass %, and REM: 0.0001-0.01 mass %.

15. A method of manufacturing the cold-rolled steel sheet according to claim 8, comprising hot rolling, thereafter cold rolling, thereafter annealing, and tempering with respective conditions (A1)-(A4):

(A1) hot rolling condition:

finish rolling temperature: $Ar_3$ point or above coiling temperature: above 600° C. and 750° C. or below;

(A2) cold rolling condition:

cold rolling ratio: more than 50% and 80% or less;

(A3) annealing condition:

holding at an annealing temperature of Ac1 or above and below (Ac1+Ac3)/2 for annealing holding time of 3,600 s or less, thereafter slow cooling with a first cooling rate of 1° C/s or more and less than 50° C/s from the annealing temperature to a first cooling completion temperature of 730° C. or below and 500° C. or above, and thereafter rapid cooling with a second cooling rate of 50° C/s or more to a second cooling completion temperature of Ms point or below; and (A4) tempering condition:

tempering temperature: 300-500° C.

tempering holding time: 60-1,200 s within the temperature range of 300° C.-tempering temperature.

16. The cold-rolled steel sheet according to claim 8, wherein $\Delta V\alpha$ is less than 5%.

17. The cold-rolled steel sheet according to claim 8, wherein RHv is 0.80-1.0.

18. The cold-rolled steel sheet according to claim 8, wherein the microstructure comprises the soft first phase by 35-50% in terms of area ratio.

* * * * *